US010808352B2

(12) United States Patent
Rozov

(10) Patent No.: US 10,808,352 B2
(45) Date of Patent: Oct. 20, 2020

(54) COMPACT DOMESTIC ARTICLE FOLDING MACHINE WITH AN IMPROVED DRIVING MECHANISM

(71) Applicants: FOLDIMATE INC., Oak Park, CA (US); Gal Rozov, Maarbarot (IL)

(72) Inventor: Gal Rozov, Maarbarot (IL)

(73) Assignee: Foldimate Inc., Oak Park, CA (US)

( * ) Notice: Subject to any disclaimer, the term of this patent is extended or adjusted under 35 U.S.C. 154(b) by 59 days.

(21) Appl. No.: 16/099,124

(22) PCT Filed: May 4, 2017

(86) PCT No.: PCT/IL2017/050491
§ 371 (c)(1),
(2) Date: Nov. 5, 2018

(87) PCT Pub. No.: WO2017/191637
PCT Pub. Date: Nov. 9, 2017

(65) Prior Publication Data

US 2019/0153661 A1 May 23, 2019

Related U.S. Application Data

(60) Provisional application No. 62/332,150, filed on May 5, 2016, provisional application No. 62/369,223, filed on Aug. 1, 2016.

(51) Int. Cl.
*D06F 89/02* (2006.01)

(52) U.S. Cl.
CPC ..... *D06F 89/023* (2013.01); *D06F 89/02* (2013.01)

(58) Field of Classification Search
CPC ..... D06F 89/02; D06F 89/023; D06F 67/04; A41H 33/00; G01B 3/10; G01B 3/005
See application file for complete search history.

(56) References Cited

U.S. PATENT DOCUMENTS 2,017,944 A * 10/1935 Braley ..... A47B 61/003 211/89.01
2,567,385 A * 9/1951 Lighter ..... B65D 85/182 53/399
3,148,807 A * 9/1964 Freeman ..... D06F 89/00 223/37

(Continued)

FOREIGN PATENT DOCUMENTS

CN 103590229 A 2/2014

OTHER PUBLICATIONS

International Search Report dated Sep. 3, 2017 for International Application No. PCT/IL2017/050491 filed May 4, 2017.

*Primary Examiner* — Ismael Izaguirre
(74) *Attorney, Agent, or Firm* — Blue Filament Law PLLC

(57) ABSTRACT

A compact domestic article folding machine configured for autonomous article folding and has machine top and bottom portions and a front and rear portions which extend therebetween. The folding machine includes a hanger rack located at the front portion and configured for receiving articles from a user at a rack external portion and move them inside the folding machine. The folding machine further includes a folding device located between the front and rear portions, and a robot configured for moving each article from a rack internal portion onto the folding device.

10 Claims, 13 Drawing Sheets

(56) References Cited

U.S. PATENT DOCUMENTS

| | | | | | |
|---|---|---|---|---|---|
| 3,477,619 | A * | 11/1969 | Lee | D06F 89/023 | 223/37 |
| 4,551,847 | A * | 11/1985 | Caldwell | G01D 5/363 | 377/24 |
| 5,179,795 | A * | 1/1993 | Nakamura | D06F 67/04 | 198/373 |
| 5,349,768 | A * | 9/1994 | Ishihara | D06F 95/00 | 38/143 |
| 5,440,810 | A * | 8/1995 | Borucki | D06F 67/04 | 38/143 |
| D466,657 | S | 12/2002 | Van Hauwermeiren et al. | | |
| 6,840,068 | B2 | 1/2005 | Pasin et al. | | |
| 6,922,911 | B2 | 8/2005 | Lam | | |
| D521,196 | S | 5/2006 | Seiffert et al. | | |
| D546,006 | S | 7/2007 | Stroud | | |
| 7,444,840 | B2 | 11/2008 | Jackson et al. | | |
| D584,866 | S | 1/2009 | Mangano | | |
| D595,460 | S | 6/2009 | Mangano | | |
| D637,369 | S | 5/2011 | Mangano | | |
| D644,383 | S | 8/2011 | Mangano | | |
| 8,973,792 | B1 | 3/2015 | Selker et al. | | |
| 2002/0088136 | A1 * | 7/2002 | Tseng | G01B 3/1061 | 33/762 |
| 2005/0120757 | A1 | 6/2005 | Jackson | | |
| 2008/0256989 | A1 | 10/2008 | Jeong et al. | | |
| 2008/0289210 | A1 | 11/2008 | Mangano | | |
| 2009/0045231 | A1 | 2/2009 | Saji et al. | | |
| 2009/0120972 | A1 | 5/2009 | Saji et al. | | |
| 2009/0282692 | A1 | 11/2009 | Seiffert et al. | | |
| 2010/0243685 | A1 | 9/2010 | Yi | | |
| 2015/0094195 | A1 | 4/2015 | Sielmann et al. | | |

* cited by examiner

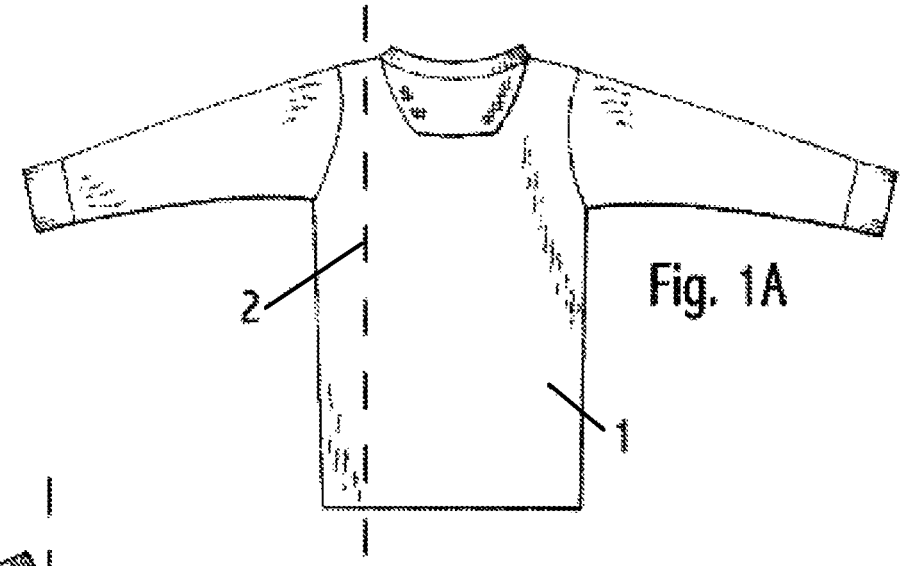
Fig. 1A
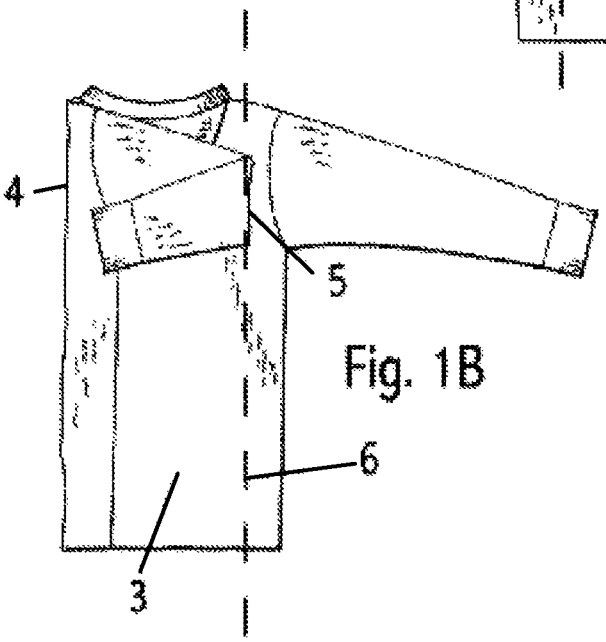
Fig. 1B
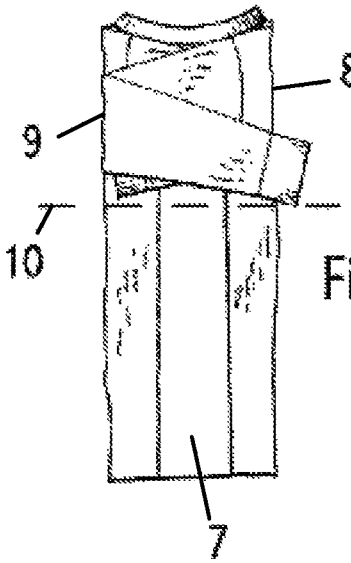
Fig. 1C
Fig. 1D
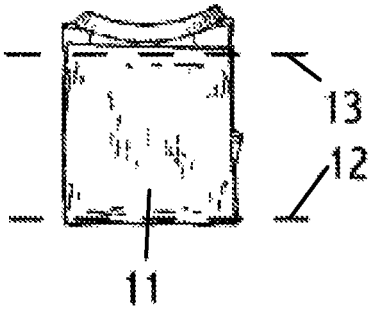

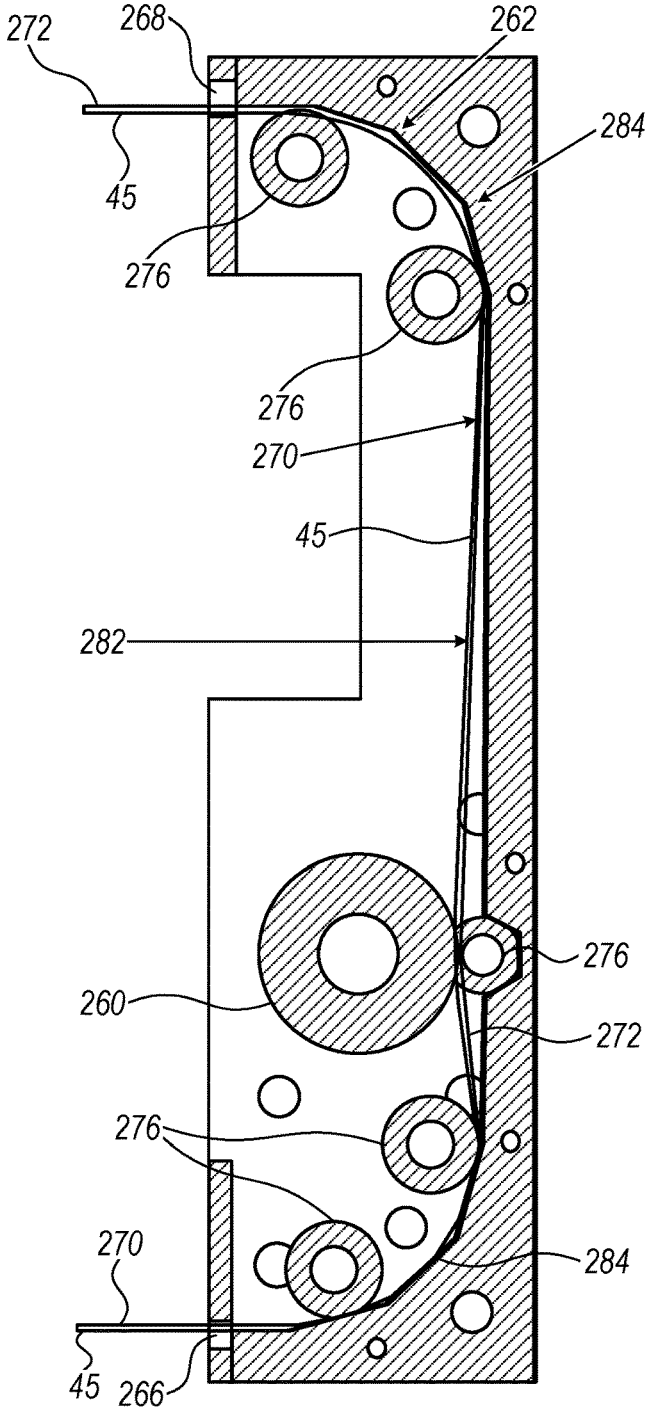
Fig. 16
Fig. 17
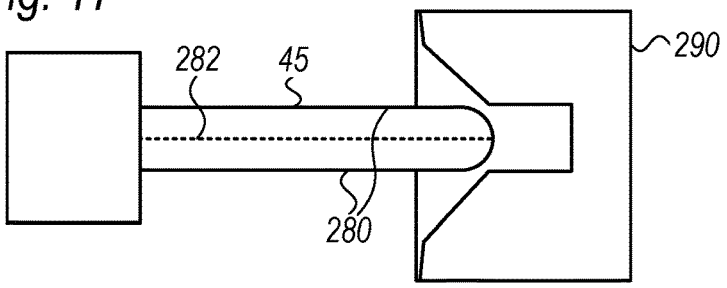

COMPACT DOMESTIC ARTICLE FOLDING MACHINE WITH AN IMPROVED DRIVING MECHANISM

This application claims priority from U.S. Provisional Application 62/332,150 filed May 5, 2016; and from U.S. Provisional Application 62/369,223 filed Aug. 1, 2016.

FIELD OF THE INVENTION

The subject matter of the current application relates to garment/fabrics folding machines. Specifically, it relates to non-industrial, very compact and light folding machines configured only for domestic use. The current application does not relate to folding machines configured for folding large items such as bed sheets, or small items such as socks or underwear.

BACKGROUND OF THE INVENTION

There has been a long felt need in the domestic consumer market for a compact, affordable product which can quickly and reliably fold our laundry. Folding machines of the field are known and disclosed, for example, in U.S. Pat. No. 8,973,792.

SUMMARY OF THE INVENTION

This folding device can receive, fold and stack fabric articles automatically. Example articles include shirts, sweaters, pants, and towels, in a wide range of fabric types and sizes.

Prior art has attempted to reproduce the motions a human uses to fold clothing. These include grasping a portion of the article and using the flat of the hand to guide that portion to a desired position, creating a fold as an artifact, as it were, of guiding a movable portion compared to a fixed portion of the article to a new position. Such machines were typically considerable larger than the article to be folded. Compared to prior art, this folding device requires less space and also reduces wrinkling.

In the scenario below, one embodiment of the folding device creates folds by a different method. A rotating rod glides smoothly between layers of the article, with portions of the article both above and below the rod. A retractable tape is used to hold a portion of the article firm while the rod moves. A first fold is created at the edge of the tape. A second fold is created at the farthest motion line of the rotating rod. This process is typically performed on the left side of a shirt, for example, then the right side, then perpendicular on the body.

The article to be folded is generally placed on a horizontal support surface, also called a platform. The rotatable rods are above the platform and below the article. The tapes extend out over the article, then down on the article to hold a portion. The platform defines an X-Y plane, with a normal Z-axis from the platform upward through the article.

The rotating rod moves in either the X- or Y-axis orthogonal to the elongate rod axis. Vertical motion permits the rod to "pick up" a portion of the article, pass over the still tape, and thus create two folds. Note that either the platform may move up and down, or the rods, or the tapes, depending on embodiment. All motions described herein are relative, and thus are equivalently accomplished by moving the other elements of the folding device and the fabric article.

The rod is conveniently associated with a tape, allowing us to refer to a rod-tape pair, even though the rod and tape may be moved independently. In a most general sense, the tape "holds" the article while the rod "folds" the article. Note that these components provide other functions in the folding device, as well.

In one embodiment two rod-tape pairs are used, with their elongate axes parallel, in order to both speed the folding process and simply the mechanisms.

In another embodiment two rod-tape pairs are used at right angles, in order to create folds at right angles.

In another embodiment, a total for four rod-tape pairs are used, with two parallel sets, each of the two sets at right angles.

In other embodiments, either the platform of the folding device rotates, thus rotating the article, or the rod-tape pairs rotate around the article. In either embodiment, folds at various angle, including 45.degree, right angles, and other angles are available.

Below is an exemplary scenario for an exemplary implementation. Broader capabilities and embodiments are explained later.

An operator places a long sleeved sweater, the fabric article, face up, roughly flat, upon a horizontal platform. The operator roughly aligns the sweater with a visible outline on the platform.

The embodiment has two horizontal, rotatable rods located above the platform, the elongate axes aligned with the sweater axis through the neck of the sweater. Each rod has a free end. We refer to these rods as the first and second rods. The embodiment also has a third and fourth, similar, horizontal, rotatable rods at right angles to the first and second rods. The sweater is placed over the rods.

Associated with each rod is a retractable, bi-stable, concave-convex tape. The tape retracts, winding into a tape container, or extends outward, horizontally, over the sweater, with the same axis as its associated rod. When extended, the tape is rigid. The tape is bi-stable in that its shape changes between the extended position and the retracted, rolled position. The concave surface facing the fabric article, such that the two edges of the concave surface first contact the article. We often refer to the rods and tapes as "rod-tape pairs" for convenience, but all motions of all rods and all tapes are independent of each other. Each rod and tape has an elongate axis.

Each rod and tape has a supported end and a free end. The mounts for a rod and tape in a rod-tape pair may be on the same side of the platform, or on opposite sides. Rods move horizontally in the X-Y plane, either along the X- or along the Y-axis. Tapes move up and down in the Z-axis.

We discuss key steps, in one embodiment, to perform one pair of folds, below. It is important to note that motions are relative. For example, the sweater moving up, or the tape moving down, are equivalent motions. We choose to describe motion to aid in readability without limiting implementations. The use of a "sweater" as a fabric article being folded is purely exemplary. The key components, for this description below, are as follows: (i) a sweater, which is on a (ii) platform; (iii) a tape; and (iv) a rod. For the key steps below, the sweater is resting on the platform; it does not move independently of the platform except for the portion of the sweater being manipulated. The steps of placing the sweater (manual or automated) on the platform and removing the sweater from the platform (manual or automated) are not included in these key folding steps. The motions described below are generally relative to the other four key components, as listed above. For example, "lowering the platform," means that the sweater and the platform move downward relative to both the tape and rod, or relative to just the rod. The steps of initializing and self-testing of the folding device are not included in these key folding steps.

For convenience, we organize the steps into four phases. The phases of steps are:

(I) grabbing the sweater;

(II) positioning the rod under the sweater;

(III) making the fold;

(IV) moving the rod back to first position;

(V) continuing with the next fold.

Some of the above phases are optional, depending on the article and the specific fold. For example, phase II may not be needed when the rod is already properly positioned. Phase V may not be needed if the fold just made is the final fold.

Key steps for one pair of folds are:

(I-A) the tape moves up over the sweater;

(I-B) the tape extends outward over the sweater;

(I-C) the tape lowers onto the sweater, so as to hold the sweater and define on the distal edge of the tape the fold line;

(II-A) the rod rotates in a first direction, this direction such that the upper surface of the rod rotates in the opposite direction as the next motion (IIC) of the rod while underneath a portion of the sweater;

(II-B) the rod is underneath the sweater distal to the tape; if it is not underneath the sweater, it is placed underneath the sweater;

(II-C) close to the platform, the rod moves under the sweater, while rotating, to a position as close to the distal edge of the tape as possible; this is the "pre-fold" position;

(III-A) the rotation of the rod reverses, such that the upper surface of the rod moves in the same direction as the next motion (III-C) of the rod;

(III-B) the rod is raised slightly (relative to the platform, sweater and tape), such that it will just clear the tape, without damaging the sweater, in the next motion (III-C);

(III-C) the rod moves parallel to the platform over the top of the tape; drawing a portion of the sweater with it both above and below the rod, while the portion of the sweater under the tape does not move, thus creating a first fold at the distal edge of the tape; (III-D) the rod continues moving until it reaches the second fold position (although in some embodiments and some folds it continues past this position); (IV-A) the rod moves parallel to the platform in the opposite direction, returning to the pre-fold position; it continues to rotate in the same direction as in (II) above, unless a snag is detected, in which case rotation is reversed; at this point the sweater has two folds: one at the first fold position as defined by the tape and a second fold position defined by the maximum movement of the rod in step (III-D); (V-A) the tape retracts; (V-B) additional folds may be created to repeating steps starting at (I-A).

The phrase, "the rod is close to the tape" means that the rod is as close to the tape as possible such that the fabric between the rod and tape is free to slide freely over the rod as the rod moves without damage to the fabric.

Some embodiments have a single rod and tape.

A preferred embodiment has a second rod and tape, where these are parallel to the first rod and tape. This second rod-tape pair may be used to create folds on the opposite of the garment from the first side.

A preferred embodiment has a third rod-tape pair, positioned orthogonal to the first one or two rod-tape pairs, used to create folds orthogonal to those created by the first one or two rod-tape pairs.

Typically, after the first side of the sweater is folded, then the second side is folded. The sweater now has a number of folds, all parallel to the sweater's primary axis, which we refer to as "side folds."

Optional third and fourth rod-tape pairs are used to create folds at a right angle to the side folds. We refer to these as "body folds."

Some of the above steps may be combined. For some folds, some steps may be omitted.

In some embodiments, folds are created at a suitable angle, such as 45.degree, from the side folds. For example, a sleeve may be folded near the shoulder at approximately 45.degree. to place the length of the sleeve parallel to the primary axis of the article.

In one embodiment, the operator may now remove the folded sweater from the platform. In another embodiment, the folding device removes the sweater from the platform automatically. The platform may tilt; or the rods may be used to lift and move the sweater; or another mechanism may move the sweater towards an output area, which may be to hold the sweater while the next article of folded, or may be a moving belt, or may be held on the platform so as to make it easy to pass a bag over the folded article and remove the bag and folded article together, for example.

In some embodiments, the operator first places the article on a "shroud" separate from the platform. The folding device then moves the article of the platform so that the article is then resting on the platform.

It is a valuable feature of this folding device that the rotating, moving rods also serve to remove wrinkles from the fabric of the article, and to generally straighten the article as it is folded (or, in some embodiments, prior to folding). It is a unique feature of this folding device that folding and de-wrinkling occurs with the same mechanism. In some embodiments, a fluid is passed through the rod onto, into, or through the article, which may assist in dewrinkling. For example, steam may be used, exiting the rod through a series of holes. Air may be passed through the rod to aid in keeping the fabric flowing smoothly over the rod while being folded. Hot air may be used to dry an article, while it is being folded. Chemicals may be passed through the rod to aid in sanitizing or odorizing the article. Chemicals or compounds may be passed through the rod where the chemicals or compounds are used to treat the article, such as to set dye, or to treat the fabric to control bacteria and odors, such as nanoparticles of silver.

In some embodiments the direction of rotation of the rod reverses. It is advantageous in some instances to have the rod spinning opposite the direction of horizontal motion (at the point of fabric contact above the rod) when the rod is below the fabric, as this tends to smooth and de-wrinkle the fabric. It is advantageous to have the rod spinning with the direction of horizontal motion (at the point of fabric contact above the rod) when the rod is between two layers of fabric, as this tends to drag the upper material with the rod evenly. In some embodiments, rotation of the rod at the upper contact with the fabric is slightly faster than the horizontal motion of the rod. Note that spinning the rod, may, in some embodiments, assist in keeping the rod straight, permitting the use of a more flexible rod that would be ideal if the rod were not spinning. However, multiple rod spin directions are not always required. In some embodiments, the rod vibrates, instead of spins. Reversing spin direction is desirable if a snag or foreign object or contamination is detected. A very smooth rod may not require spinning. Static charge may be used, in some embodiments, to assist in keeping fabric and fabric threads away from the rod, avoiding friction, drag, wear, and possible snags.

A unique feature of this folding device is that in some embodiments it is smaller, at least in one dimension that the fully extended article to be folded. For example, the sweater arms may initially hang off the side of the platform.

Multiple rod-tape pairs permit faster folding operation as more than one fold may be in process at once. Also, a subsequent fold may initiate immediately after an earlier fold because the rod-tape pair has been pre-positioned for that subsequent fold.

In another embodiment, the rod retracts after step (III-D) above, in a third direction of motion (not counting rotating), so as to leave both the tape fold and the rod fold intact.

In some embodiments, air, steam, water, chemicals, fragrance, or nanoparticles (referred to as "rod fluids") are dispensed into or through the article as it is folded, via a the rods, the rods being hollow with openings in the rod for the rod fluid to exit the rod one or more surface locations on the article. These fluids may clean, sterilize, de-scent, de-wrinkle, press, or chemically treat the article while it is being folded. Such actions reduce or eliminate steps.

Various embodiments of this folding device are most applicable for article manufacturing, retail stores, hospitality facilities, laundromats and dry cleaners, and home use, depending on embodiments, features, size, flexibility, speed, ruggedness, and cost.

Additional extensions and features of this folding device include automatic identification, inspection, scanning, tagging, and packing articles. Machine learning may be incorporated to improve performance and article recognition. RF-ID transponders in article tags are one method of automatically identifying articles.

Worn, contaminated, or damaged articles may be detected either by sensors on the folding device of by detecting that the necessary force or torque on a tape or rod is excessive (for any motion of the tape or rod where it might be in contact with the article). Such article may then undergo a difference series of actions than a non-worn, non-contaminated, undamaged article. Examples of such problems include hair, gum, sticky spots, tangled fabric, tears, pins, loose buttons, loose threads, and the like.

In accordance with a first aspect of the subject matter of the present application there is provided a compact domestic article folding machine configured for autonomous article folding and having machine top and bottom portions and a uniform body extending therebetween and comprising machine front, rear and side portions, the folding machine comprising:

a hanger rack located at the front portion and configured for receiving articles from a user at a rack external portion and moving them inside the folding machine;

a folding device located between the front and rear portions; and a robot configured for moving each article from a rack internal portion to the folding device to be folded.

In accordance with a second aspect of the subject matter of the present application there is provided a driving mechanism configured for driving and bending a semi-rigid holding member of a folding machine, the driving mechanism comprising a driving portion which only contacts the holding member along a longitudinally extending strip-portion which is located midway between two longitudinal side edges of the holding member.

Any of the following features, either alone or in combination, may be applicable to any of the aspects of the subject matter of the application:

The hanger rack comprises top and bottom bars connected by two chains onto which multiple hangers are clamped, and wherein the top bar is located farther away from the machine rear portion than the bottom bar.

The folding machine can have the following maximum external dimension ranges:

700-1000 mm as measured between the machine top and bottom portions;

330-400 mm as measured between the machine side portions; and 400-500 mm as measured between the machine rear and front portions.

The folding device is configured for creating a fold in a fabric article and comprises:

a table for supporting the fabric article;

a holding member which has an elongated holding axis and adjustable between a retracted position and an extended position;

a folding member which has an elongated folding axis and movable in a direction perpendicular to the holding axis, the folding member is configured to create a fold in the fabric article along the holding member by carrying at least a portion of the fabric article over the holding member;

- a motor operatively connected to at least one of the holding member and the folding member; and
- a movement means configured to adjust a distance between the holding member and the fabric article;
- the holding member is configured to retract and leave the fold.

At least one dimension of the table is smaller than a corresponding dimension of the fabric article, in a plan view thereof.

At least one dimension of the folding device is smaller than a corresponding dimension of the fabric article.

The folding member includes fluid or gas conveying channels, and is configured for fabric treatment via said channels.

The holding member can be a concave-convex tape.

The folding member can be a cylindrical rod configured to rotate about the folding axis.

The folding member can be configured to rotate in two opposite directions.

The folding member can be configured to vibrate to overcome entanglement or snags in the fabric.

The folding device can include detection sensors configured to detect fabric contaminations or damage.

The folding member is not retractable.

The folding device can include:

first and second holding members and first and second folding members arranged in pairs, each pair comprises one holding member and one folding member, wherein the first pair is oriented perpendicular to the second pair.

The total folding time can be less than 1 minute per article being folded.

The total folding time can be less than 10 seconds per article being folded.

The holding member is made of metal, plastic or coated metal.

The driving portion contacts the holding member only before or after a bend apex generated by a bending portion.

The driving mechanism comprises a support member which only contacts the holding member along a longitudinally extending strip-portion, which is located midway between two longitudinal side edges of the holding member.

The support member contacts the holding member only before or after a bend apex generated by the driving mechanism at the bending portion.

The driving mechanism comprises an output opening which has a relief concave portion.

The shape of the input and output openings is not a parallelogram.

The a holding member anchor is aligned opposite the output opening, and comprises a recess which matches the holding member shape, and configured to receive and support the holding member in an extracted state.

BRIEF DESCRIPTION OF THE DRAWINGS

For a better understanding of the subject matter of the present application and to show how the same may be carried out in practice, reference will now be made to the accompanying drawings, in which:

FIGS. 1A, 1B, 1C, and 1D show the sequence of steps in one embodiment of a shirt being folded;

FIG. 16 is a cross-sectional view of the driving mechanism of FIG. 15 taken along line XV-XV of FIG. 15; and FIG. 17 is a top, or plan, view of a holding member about to enter a holding member anchor.

Figure 2A:
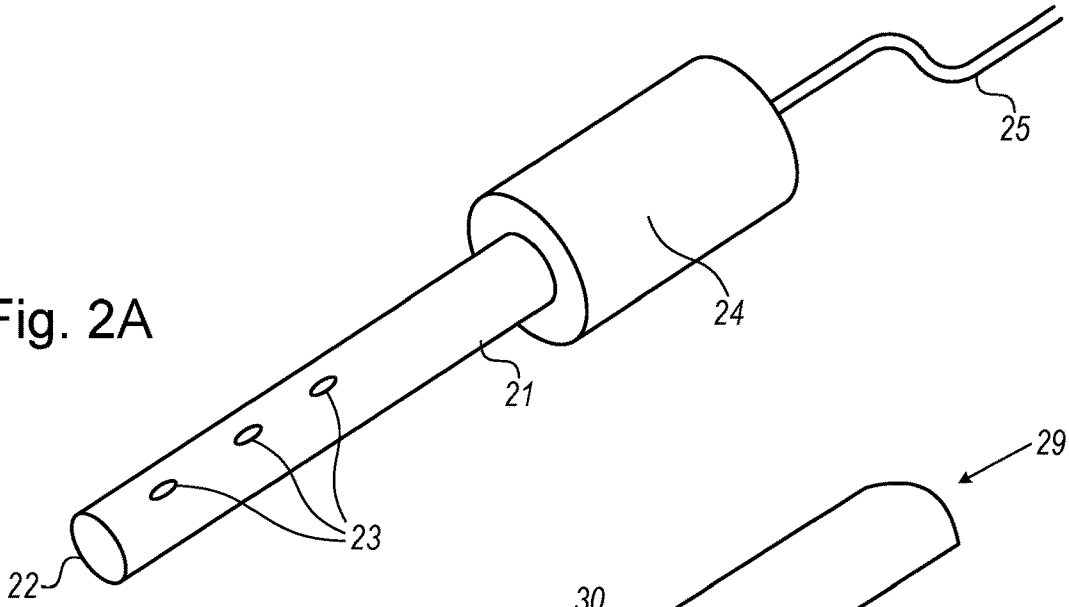
FIG. 2A shows one rod and a motor for spinning the rod.

Where considered appropriate, reference numerals may be repeated among the figures to indicate corresponding or analogous elements.

DETAILED DESCRIPTION OF THE INVENTION

In the following description, various aspects of the subject matter of the present application will be described. For purposes of explanation, specific configurations and details are set forth in sufficient detail to provide a thorough understanding of the subject matter of the present application. However, it will also be apparent to one skilled in the art that the subject matter of the present application can be practiced without the specific configurations and details presented herein.

FIG. 1A shows a fabric article, here a long-sleeve shirt, in a position to be folded. 1 is the shirt prior the start of folding. It is helpful to consider the shirt sitting roughly horizontally on a platform or table, with a Y-axis through the collar along the primary axis of the shirt; an orthogonal horizontal X-Axis, and vertical Z-axis normal to the X-Y plane on which the shirt lies. The views in FIGS. 1A through 1D are overhead views, looking down. 2 is the first fold line, which is parallel to the Y-axis. A tape (not shown in this Figure) moves over the shirt and then contacts from the shirt the shirt from above so that it's distal edge is aligned with the shown fold line 2. Contact with the shirt may be achieved in three ways. First, the tape may lower to touch the shirt. Second, the platform supporting the shirt may rise to meet the tape. Third, the tape may already be at the correct height (above or on the fabric); as the tape is extended it glides over the surface.

Refer now to FIG. 1B. Described elsewhere is the precise sequence of steps to accomplish one fold or a pair of folds. Here a rod (not shown in this Figure) is under the left side of the shirt (where "left" is as the viewer looks at this Figure), under the fabric, lifting up the fabric distal to the fold line 2, then moving to the right over the top of the tape, to the second fold line 6. This operation creates two folds: a first fold at 4, comprising the body of the shirt, and a second fold at 5, in the left sleeve. The partially folded shirt is 3. The tape, which defined the first fold at 4, now retracts.

FIG. 1C shows the shirt, 7, after the second set of two folds. These are accomplished similar to and symmetrically to the first two folds on the left side of the shirt, as shown in FIG. 1B, but are now on the right side of the shirt. In one embodiment, a second rod-tape pair is used to accomplish these two folds. 8, a fold in the body of the shirt is the third fold position. 9, in the right sleeve, is the fourth fold. Dotted line 10, parallel to the X-axis, shows the position of the fifth fold. In one embodiment the fifth and six folds are accomplished by a third rod-tape pair.

FIG. 1D shows the shirt 11 fully folded, after the fifth and sixth folds. 12 shows the fifth fold position while 13 shows the sixth fold position. The fifth and sixth folds are orthogonal to the first through the fourth folds, in this example.

The final shirt, 11, is in the form of a rectangle. The locations of the first and second fold positions (4 and 5, respectively), and the fifth and sixth (12 and 13, respectively) fold positions are generally selectable to create a desirable final size and shape of the folded article. Generally, the first and forth fold positions are similar, as viewed against the X-Y plane, as are the second and third fold positions. However, this is not necessary.

FIG. 2A shows an exemplary rod with an exemplary motor to spin the rod. The rod is 21. Rods may be solid or hollow. The rod should be reasonably rigid so that it need be supported at only one end. It should be a low-cost, non-corrosive material that will not damage the fabric articles. A suitable rod material is ¼" diameter solid aluminum. Smooth polypropylene is another suitable material. The length of the rod should be long enough, in most embodiments, to reach across the article to be folded. The end of the rod should be blunt, 22, so as to not damage the article. Here, three holes, 23, are shown in a hollow rod. A rod fluid, such as air, steam, fragrance, or many other fluids, may be moved through the rod and then onto or through the fabric. A motor, 24, may be an electric motor, here shown with electric leads, 25. It is advantageous to be able to reverse the motor direction. Here, the motor shown is a DC motor; direction may be reversed by changing the direction of current through the leads 25. Alternatively, motors may be hydraulic, wind up, or remotely connected to the rod through a mechanical or magnetic coupling.

Figure 2B:
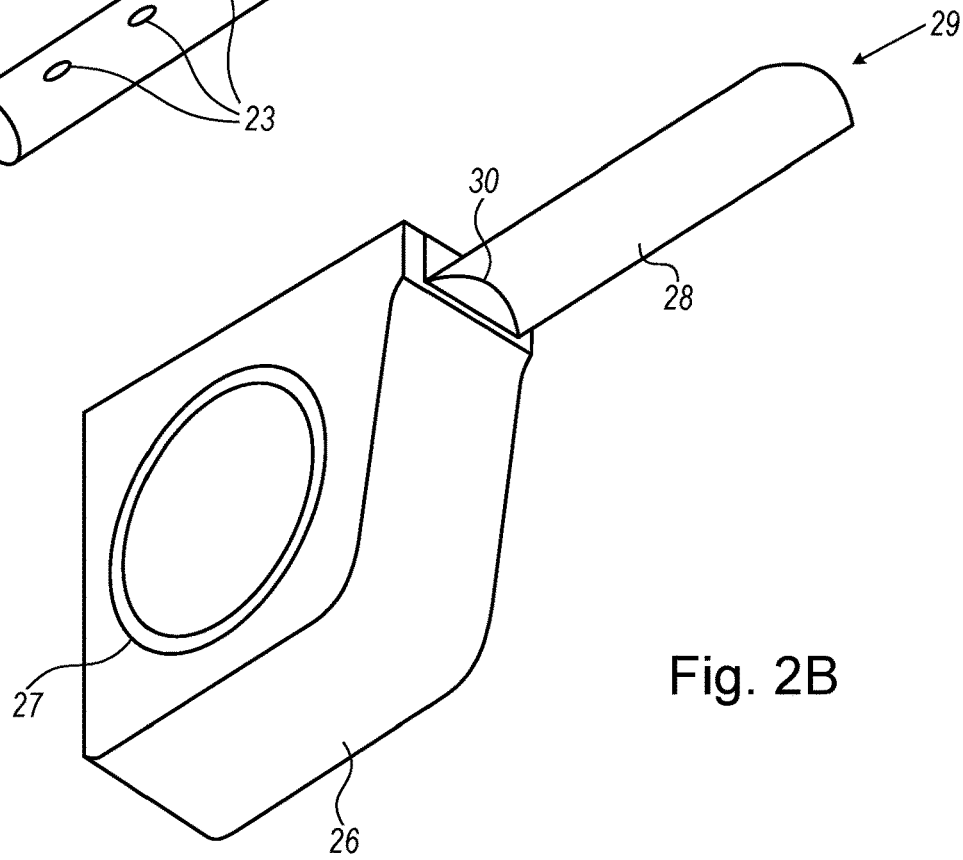
FIG. 2B shows a tape partially retracted.

FIG. 2B shows a partially retracted tape, 28. The concave-convex tape is bi-stable in that it has one cross-sectional shape when extended and a different cross-sectional shape when coiled in the receptacle 26. The tape may be efficiently coiled inside the receptacle, 26. The basic mechanical design of the tape and receptacle is similar to a common tape measure. Note, however, that no measurement markings are required on the tape, and that the end of the tape must be smooth so as to not catch or damage the fabric during either extension or retraction. Note also that the extension and retraction of the tape are powered, as the extension and retraction are key steps in the automatic operation of this folding device 202. Extension and retraction may be achieved by rotating the spool around which the tape is wound, 27. Alternatively, the tape may be extended and retracted by the use of one or rollers or capstans (not shown), such as a rubber pinch roller. A device, such as a motor, for these purposes, is not shown. The end of the tape is shown, 29. However, the end of the tape 29 should not be square or sharp, but should be rounded, as will be discussed below, so as to glide smoothly over the fabric during both extension and retraction. 30 shows the point at which the tape 28 enters the receptacle 26.

A key feature of one embodiment is that the concave-convex tape is concave downward, when extended. This is "upside down" compared to the general use of most tape measures. For a tape measure, the tape is concave upward when extended to provide strength against gravity collapsing the extended tape. For this embodiment, the tape is concave downward to permit pressure to be applied between the article to be folded and the tape. From the view of the tape, this pressure is upwards. Note that the tape must be rigid enough to be self-supporting against gravity when extended, even though it is "upside down." In some embodiments the tape receptacle may be placed conveniently out of the way, such as below the support platform. One or more rollers may then be used to direct the tape between its receptacle and its extended position above or on the fabric article. A suitable tape material and dimensions are similar to, although in some embodiments stronger, than a common, heavy-duty, measuring tape. For example, coated or painted spring steel, ¾ inch wide, 20 thousands of an inch thick, about the same length as the rod in the rod-tape pair.

Figure 2C:
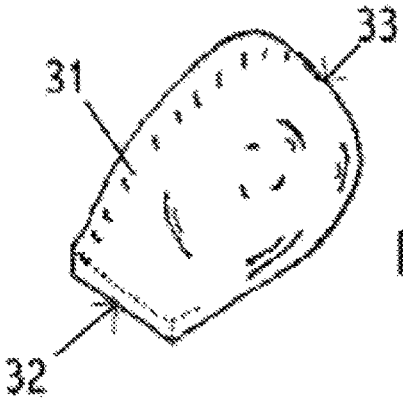
FIG. 2C shows one embodiment of a tape end.

FIG. 2C shows an exemplary rounded tape end, 31. This tape end may be smooth, molded plastic such as a polyamide. The rounded tape end may be secured to the tape with a press fit or an adhesive. Here is shown the blunt, final end, 33, and an opening, 32 into which the end of the metal tape (shown as 29 in FIG. 2B) is inserted.

Figure 3:
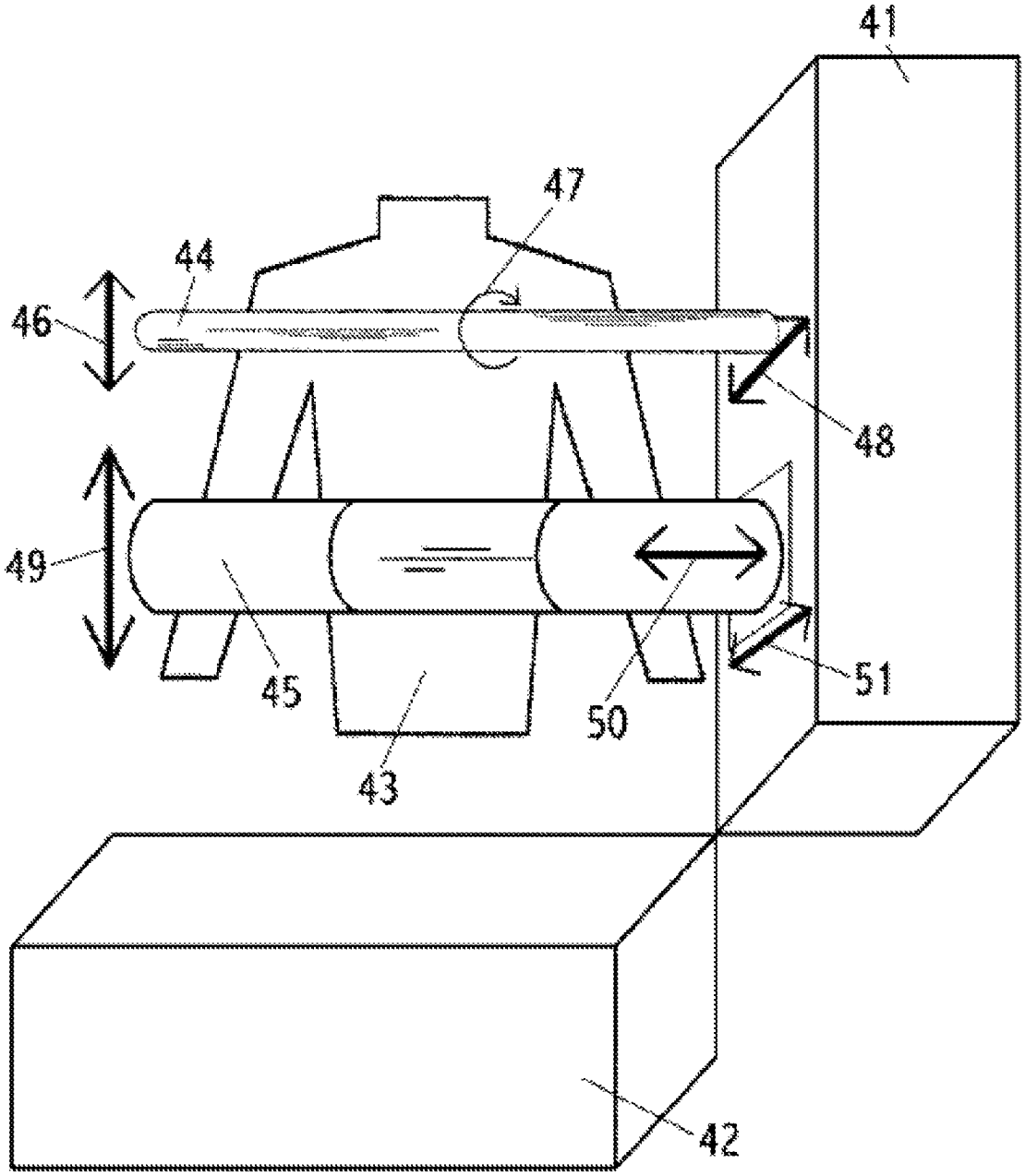
FIG. 3 shows a rod and a tape, along with their respective directions of motion relative to a fabric article to be folded.

FIG. 3 shows an exemplary arrangement of a rod-tape pair positioned over an exemplary article to be folded, here a shirt, 43. In this embodiment, there are two rails, a right rail 41 and a lower rail 42. These rails support the rods and tapes, and provide the mechanical mechanisms to provide the motions of the rods and tapes. Not shown in this Figure is a platform to support the fabric article. Not shown in this Figure is a mechanism to raise and lower the platform. One rod is shown, 44, and one tape, 45. The tape, 45, is its extended position. Note, again, that we often refer to rod-tape pairs for convenience, however, the rods and tapes may be operated completely independently, and an embodiment does not need an equal number of rods and tapes. For the embodiment shown in this Figure, consider that the shirt shown, 43, is flat and horizontal. The primary axis of the shirt will be known as the Y-axis. Orthogonal to the Y-axis, but still horizontal is the X-axis. The Z-axis is vertical in this embodiment. The rod 44 is parallel to the X-axis. It has three motions: First, horizontal motion along the Y-axis, 46. Second, rotation, 47, including the ability to reverse rotation. Third, vertical motion along the Z-axis, 48. This vertical motion 48 may be implemented by raising or lowering the platform (not shown) on which the article is sitting. The tape 45 is generally parallel to the rod, 44. However, in some embodiments the tape and rod are not parallel. The tape 45 has three motions. First, horizontal motion along the Y-axis, 49. Second, extension and retraction, 50. When retracted, the end of the tape is clear of the article, 43. Third, vertical motion along the Z-axis, 48. This vertical motion 48 may be implemented by raising or lowering the platform (not shown) on which the article is sitting. Tapes may be mounted on the platform.

Figure 4:
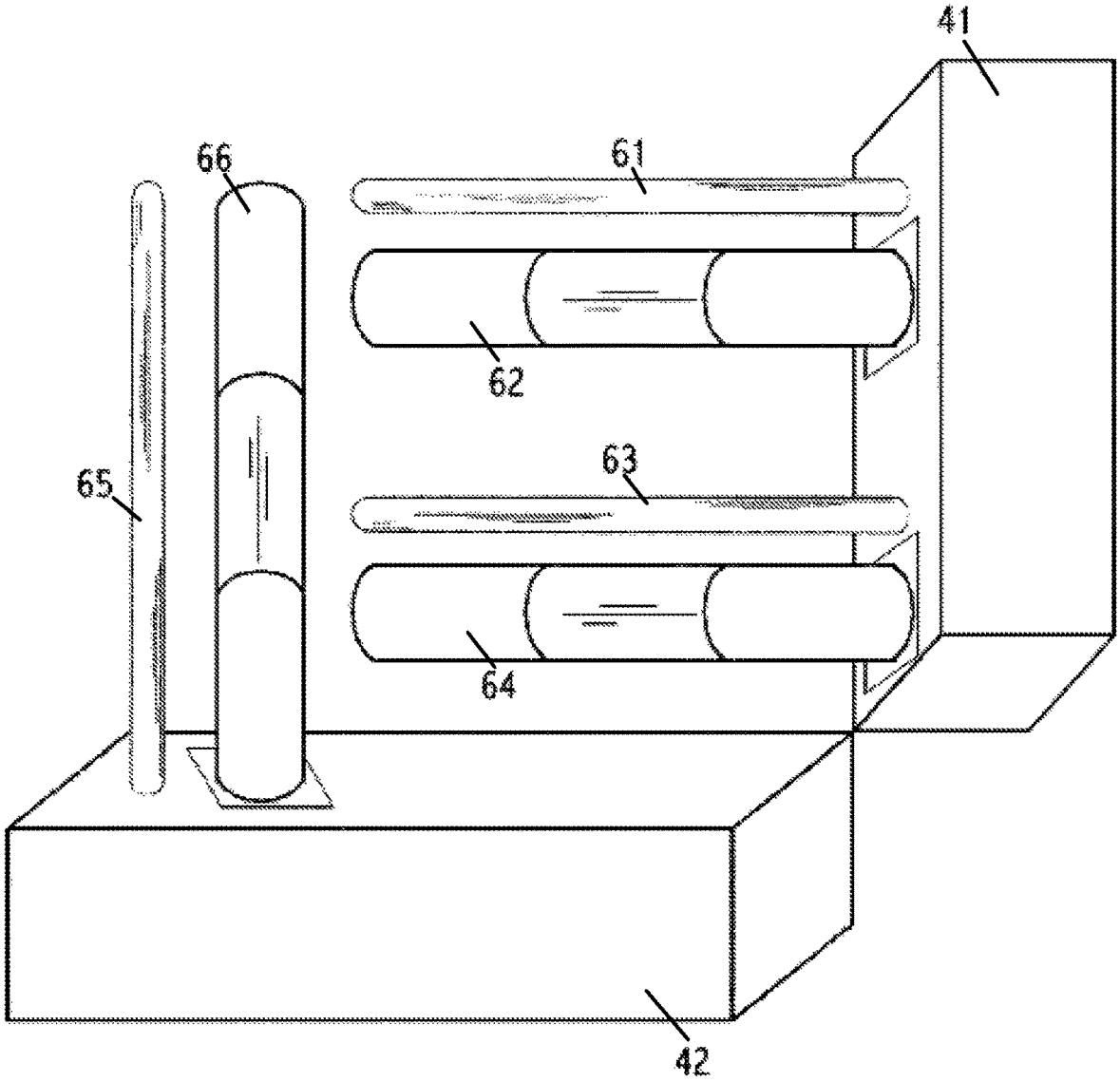
FIG. 4 shows an embodiment with two rod-tape pairs in one axis and a third rod-tape pair in another axis.

FIG. 4 shows an embodiment with three rod-tape pairs. The right frame 41 supports and provide motions for two rod-tape pairs, while the lower frame supports and provides motions for the third rod-tape pair. The first rod tape pair is 61 and 62, respectively. The second rod tape pair is 63 and 64, respectively. The third rod tape pair is 65 and 66, respectively. All three tapes, 62, 64 and 66, are shown in their extended position. Motions of the various rods and tapes must be coordinated to avoid interference. In this embodiment, there are two rails, a right rail 41 and a lower rail 42.

Figure 5A:
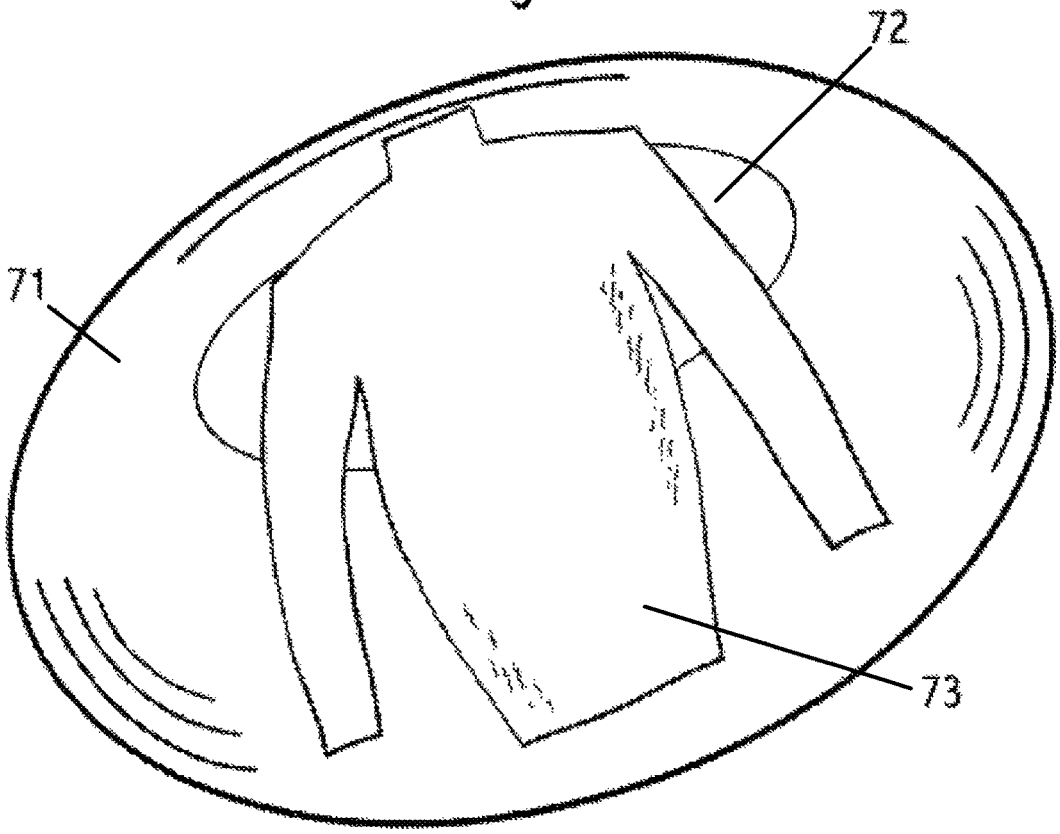
FIG. 5A shows a fabric article placed on a curved support platform.

FIG. 5A shows an article support platform 71 with an article placed on it 72. In this embodiment, the article support platform is circular and curved, with the center higher in a smooth, convex shape. This shape helps assists the user in centering and aligning an article 73 for folding. The concave surface allows the outer portions of the garment or article to drape slightly, due to gravity, spreading the article. Many other platform shapes are possible, including rectangular and flat. Here, a circle at the center of the platform, 72, assists a user in centering the article.

In one embodiment, a portion of the platform may lower between the time that a user places an article and the time the folding operation begins. This allows a user to place an article on a smooth, easily accessible platform, possibly raised for convenience. Then, the article is lowered into the folding device 202 in an area where the folding steps occur. In FIG. 5A, the center portion 72 may move separately from the outer portion 71. Note that the shown dimensions are not to scale. In one embodiment the article to be folded is "sucked into" the folding portion of the machine. A vacuum table or portion of a vacuum table may be used. In other embodiments the platform changes shape, elevation or form in order to provide both a convenient table on which a user may place an article and also provide a suitable work surface for the folding steps.

In some embodiments the article to be folded in placed directly on the platform or table used for the folding steps. In other embodiments, the article is first placed on a "shroud," or other surface, and then transferred to the folding platform. The surface in FIG. 5A may be either a shroud or the folding support platform.

Figure 5B:
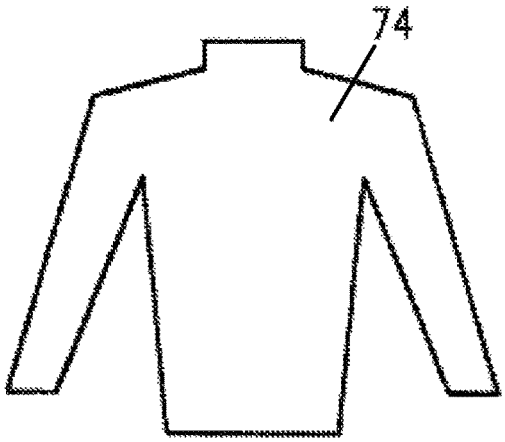
FIGS. 5B and 5C show outlines used to assist operators in placing articles on a support platform.
Figure 5C:
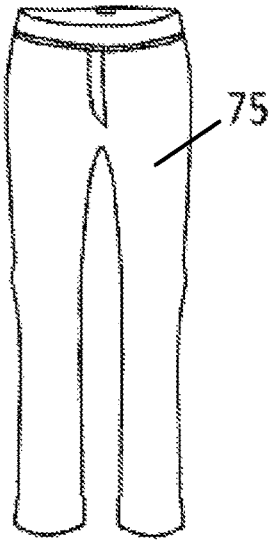

FIGS. 5B and 5C show exemplary outlines of articles to be folded. In one embodiment, one or more of these outlines are visible to users. Such outlines assist the user in proper or optimum placement of articles to be folded. Of particular importance is that the article is centered left-to-right so that the folding is symmetric, and that the article's axis is aligned with the primary folding axis, so that the fold lines are parallel to the articles primary axis. These outlines may be painted on the platform or shroud, or molded, or otherwise visible. In some embodiments, the outline is dynamically alterable. For example, the user may select a long-sleeve shirt to folded, rather than trousers. The folding device 202 then provides the outline 74 shown in FIG. 5B rather than the outline 75 shown in FIG. 5C. Such an outline may be projected from above, projected from below, or lit internally. For example, the outline may be translucent plastic embedded in an opaque platform. More than one such outline is embedded, however only one such outline is illuminated at a time. Note that the rear tag and the front fly is visible on outline 75 in FIG. 5C. These indicate an orientation that is "face-up." Visible buttons or a zipper are examples of such "face up v. face-down" orientation on an article outline. Alternatively, and image of a tors, mannequin or face may be included to provide such face-up v. face-down orientation. Such orientation symbols are helpful in some embodiments to produce a set of desirable final folds.

A variation of FIGS. 5B and 5C is the use of a torso or partial torso outline, symbol or representation. An outline or partial outline of a mannequin may be used. For example, a user may then place the article to be folded on this outline as if "dressing" the torso, partial torso, or outline.

Figure 6:
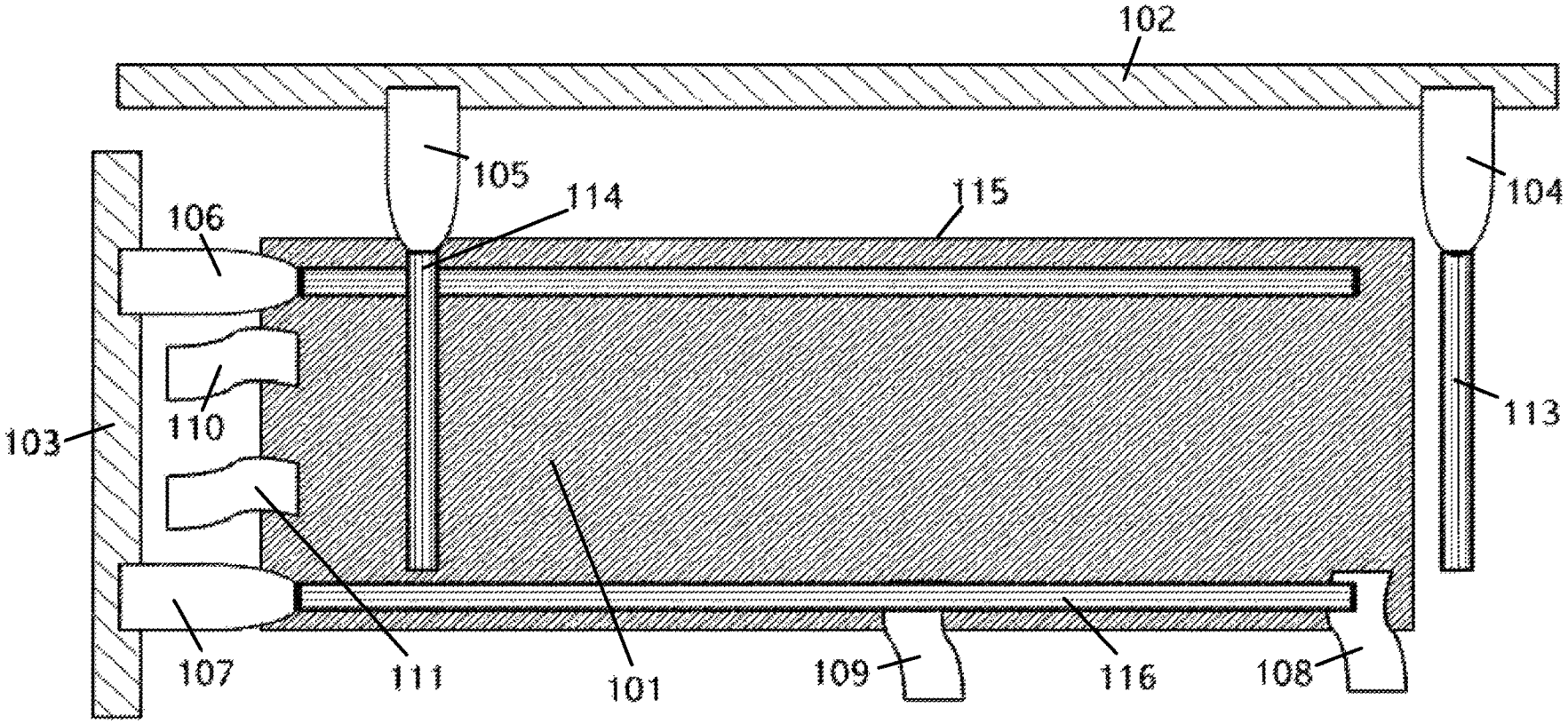
FIG. 6 shows an overhead view of one embodiment.

FIG. 6 shows an overhead view of one embodiment. The platform or table is 101. As shown, the table is generally horizontal (although it may be tilted) and defines and X-Y plane. Normal to the table is the Z-axis, where up is towards the viewer in this Figure. Two orthogonal rails, long side 102, and short side 103, are shown. These rails typically support and provide motion for the rods. This embodiment uses four rod-tape pairs. The four rod motors are 104, 105, 106, and 107. The rod motors spin four rods, 113, 114, 115, and 116, respectively. Ideally, these motors are reversible. Ideally, these motors have a mechanical, electric, electronic, or hydraulic clutch that provides a maximum rotational torque to avoid damaging the article in the event of a snag or contamination. The form of this clutch may be electronic or partially implemented in software using either the measurement of the motor current or measurement or the rotational speed, or both, to determine the effective resistance against the rotating rod. Four tapes are shown, 108, 109, 110 and 111, which may be considered part of four rod-tape pairs: 104-108, 105-109, 106-110, and 107-111. However, rods and tapes may be fully independent. In this exemplary embodiment, the four tapes are mounted on the table, 101. The four rod motors spin in either direction. The two rod motors 104 and 105 move along rail 102 in the X-axis. The two rod motors 106 and 107 move along rail 103 in the Y-axis. The rods and the rod motors may not move together. For example, a rod motor might spin a pulley, which then indirectly spins its rod. The tapes extend and retract. The tapes move in the Z-axis up and down. In some embodiments, the tapes also move in the X-Y plane. The table moves up and down. In practice, consideration must be given to mechanical interference of all components.

Figure 7:
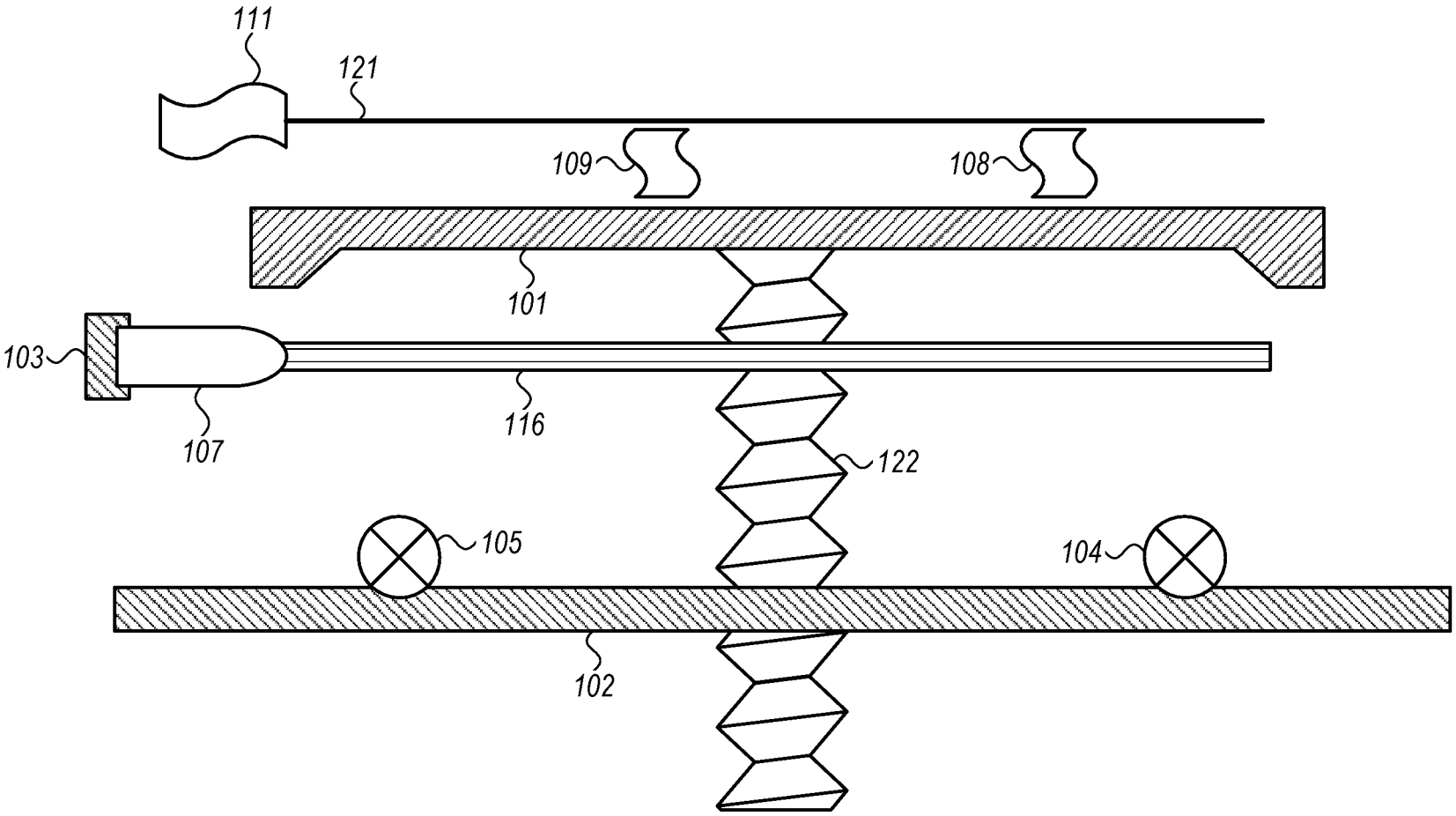
FIG. 7 shows a side view of one embodiment.

FIG. 7 shows a side view of one embodiment. The enclosure and most supporting frame elements are not shown. The long side rail 102 is shown, along with an end view of short side rail 103. Here the table 101 in a high position. The table may be raised and lowered by a variety of mechanisms, here a driven screw, 122. Mounted on the table, 101, are four tapes. Three of these tapes are visible, 108, 109 and 111. Tapes 108 and 109 are shown in end-view. Tape 111 is shown in side view, with its tape, 121, extended over the table, 101. After an article to be folded is placed on the table, 101, the table moves to a first elevation position. Generally, the first folds are long folds, folding the sides of the garment inward. Rod 116 driven by motor 107 would be used, along with tape 111, for this purpose. The first elevation position for the table is just below rod 116. When the folds at the first elevation are completed, the table 101 lowers to a second elevation. At this second elevation the top and bottom of the garment are folded. This second elevation is just below rods 104 and 105, shown in the Figure in end view. Folds at this second elevation typically use rods 104 and 105, and tapes 108 and 109. Typically, the table, 101, then moves to an appropriate elevation to discharge the completely folded article, or have it manually removed.

Figure 8:
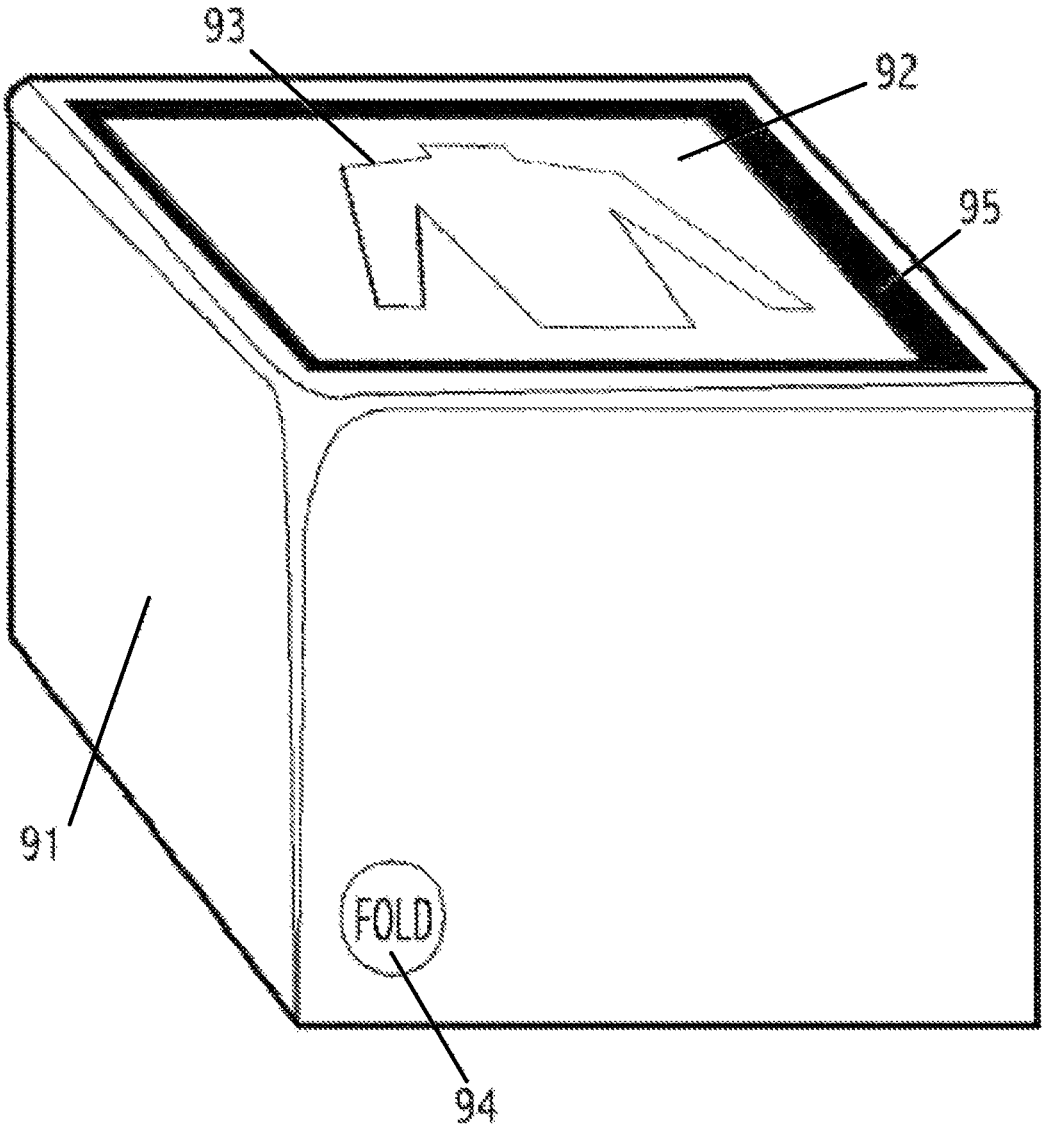
FIG. 8 shows an enclosure for one embodiment and a shroud.

FIG. 8 shows an enclosure for the mechanical elements of the folding device 202, in one embodiment. The enclosure is 91. Either the table rises to the top of the enclosure 91 to accept an article to be folded, or a shroud is used, 92, to accept the article, which is then transferred to the folding table. An outline of the article may be visible, 93, to assist the user in placing the article. This outline may be painted, projected, or backlit, as examples. More than one outline may be available, dynamically selected, based on the type of article to be folded. After the article is placed, the user indicates that folding should start, for example, by pressing a "FOLD" button, 94. For safety reasons, the machine should stop if a hand or other foreign object is placed within the enclosure, 91. For this reason a protection zone, 95, is provided. This zone may also comprise mechanical clearance between the table or shroud, 92, and the sides of the enclosure, 91.

Figure 9A:
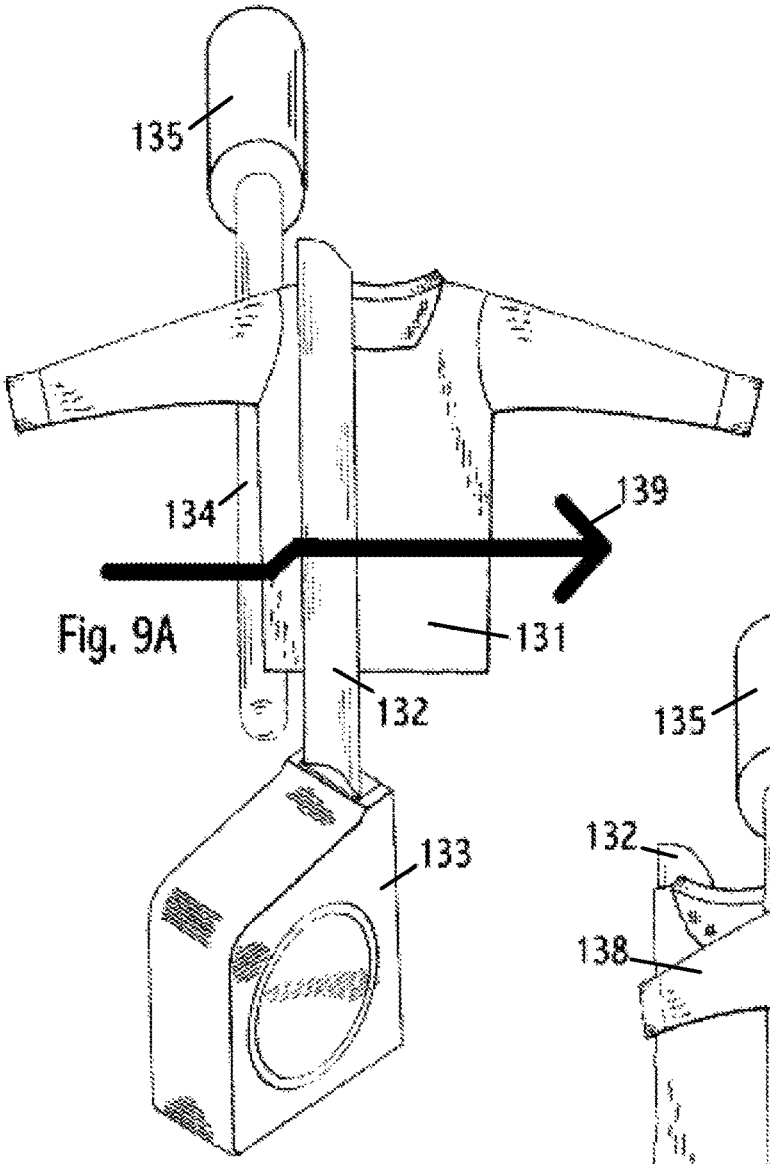
FIGS. 9A and 9B show two snapshots in an exemplary folding sequence.
Figure 9B:
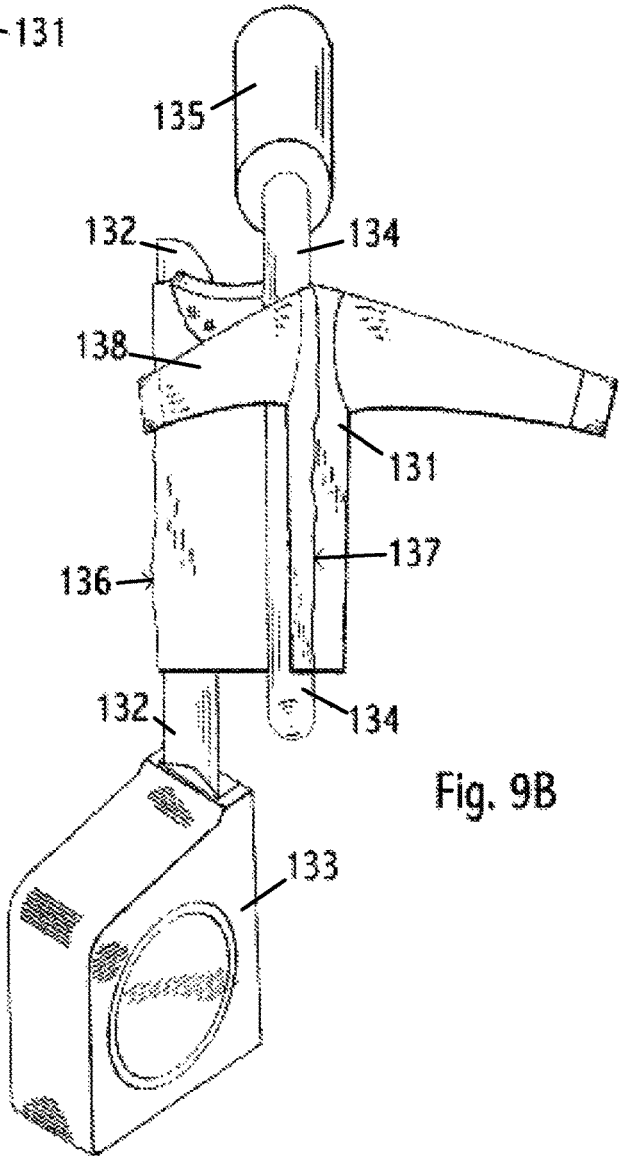
Figure 11:
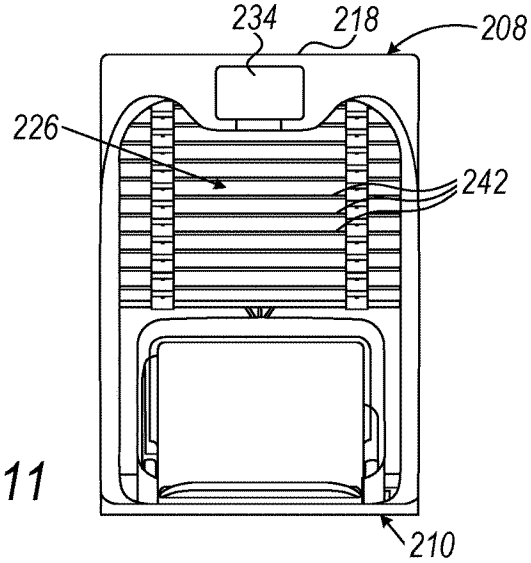
FIG. 11 is a front plan view of a machine front portion of the folding machine of FIG. 1.
Figure 13:
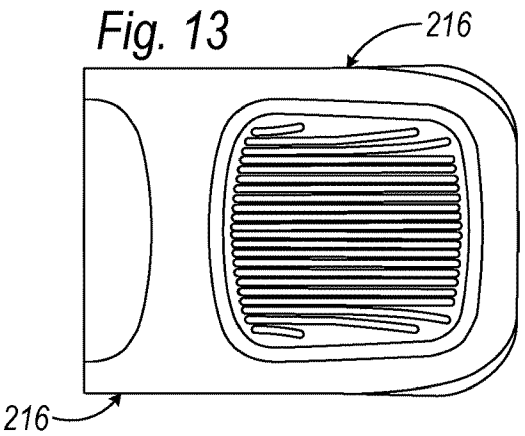
FIG. 13 is a top plan view of a machine top portion of the folding machine of FIG. 1.
Figure 12:
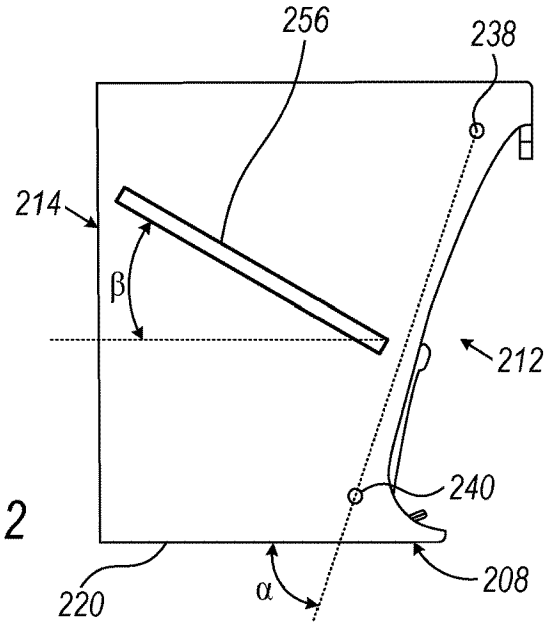
FIG. 12 is a side plan view of a machine side portion of the folding machine of FIG. 1.

FIGS. 9A and 9B show two snapshots of an exemplary folding sequence. Prior to the snapshot of FIG. 9A, the sweater 131 is placed; the tape 132 extends over the sweater 131 and lowers onto the sweater to hold it. As described elsewhere, note that the edges of tape 132 face the sweater 131. The sweater 131 is over the rod 134, rotated by the rod motor 135. 133 shows the tape spool and spool enclosure, as described elsewhere. Thus, we see in FIG. 9A the point at which folding is about to begin. The rod 134 will move close to the tape 132; then slightly upward such that the sweater material is between the tape 132 and the rod 134, then the rod 134 will move horizontally in the direction of the arrow 139 over the top of the tape 132, pulling some of the sweater 131, including the left (as facing the sweater in this Figure) sleeve to the right, as shown by the arrow 139. The pressure of the tape 132 against the sweater 131 holds the fabric between the tape 132 and the platform (not shown) securely such that it is not pulled laterally by the rod 134.

In FIG. 9B we see the result of the motion described above. The tape 132 is in the same location as in FIG. 9A. The rod 134 has moved to the right, creating two folds: a first fold 136 defined by the distal edge of the tape 132; and a second fold 137 defined by the distal edge of the rod 134. Again we note the rod rotation motor 135 and the tape spool and enclosure 133. A this point in the folding sequence, the rod's 134 direction of rotation may reverse, as driven by the rod motor 135, then the rod may move out from under a portion of the sweater by moving in the opposite horizontal direction; that is, opposite to arrow 139. Also the tape 132 retracts into the spool 133. This latter rod motion and tape retraction steps may occur in either order, or at the same time. As a result of these folding steps, the sweater's left sleeve 138, has been neatly folded on top of the body of the sweater, 131.

Note that the sweater 131, the tape 132, and the rod 134 are not to scale in FIGS. 9A and 9B. Neither are these two Figures perspective-accurate.

In one embodiment a second rod-tape pair, with the rod starting under the sweater, then makes a second pair of folds, parallel to the two folds described above.

In one embodiment, a third, and possibly a fourth rod-tape pair, orthogonal in orientation to the first two rod-tape pairs, create one, two or more folds orthogonal to the folds 136 and 137 shown in FIG. 9B.

In some embodiments, a single sensor may provide more than one function. In some embodiments, a physical stop may be used in place of a limit sensor. In general, limit sensors and safety sensors provide a binary output. In general position sensors provide a numerical output, which may be either analog or quantized (i.e. digital). In some embodiments, it is advantageous to know the thickness of the article, both prior to folding and during folding. Similarly, it is often advantageous to know when a tape has come in contact with the article. As those trained in the art appreciate, sensors may be mechanical, optical, use reflected IR, machine vision, electrical conductivity, encoder disks, tilt switches, and numerous other sensor technologies. As one example, a single machine vision sensor could provide the necessary information to implement. Additional sensors are used in some embodiments.

Operation of the machine may be guided by machine vision. A camera and machine vision software may be used to determine the centerline of an article, its outline, the type of article, rotation of the article, and foreign objects. The machine may be directed based on this information, or a warning to the user may be provided. A weight scale may be used to determine if the article is reasonably centered by the user prior to the start of folding.

Mechanisms to move the rods, tape and fabric support platform include but are not limited to: a motor, including electric, wind-up, or pneumatic; a motor attached to a screw drive or wheel; a cable on a driven wheel; with the cable attached to the moving element; air or pneumatic powered, such as by means of a piston. Return motions may be similarly powered, or may be via a spring, pneumatic pressure, or gravity. Such mechanisms may involve use of tracks, gears, levers or belts. It is not necessary that the tape coil in its retracted position.

Definitions

Article—A foldable article of fabric, such as foldable clothing, napkins, towels, pillow cases, sheets, blankets, tarps, flags, table cloths, and the like.

Concave-convex tape—A tape that when viewed from the end is curved. When the tape is extended in a straight line its preferred bend is concave. When the tape is rolled the curve flattens or reverses. Such bi-stable tapes are commonly used in tape measures. Note that the use of the holding member 45 in this folding device 202 is "upside down" from the most common orientation of such measuring tapes.

Distal—More distant from the center of the article.

Fabric—Includes woven material, cloth, and non-woven material.

Foldable clothing—Foldable clothing comprises a large number of name articles, without limitation, including shirts, blouses, pants, trousers, leggings, sweaters, jackets, dresses, skirts, gowns, ties, scarfs, tights, nylons, socks, under garments, and many more.

Primary axis of wearable clothing—For clothing for the torso, through the center of the neck. For pants, through the center of the waist.

Figure 10:
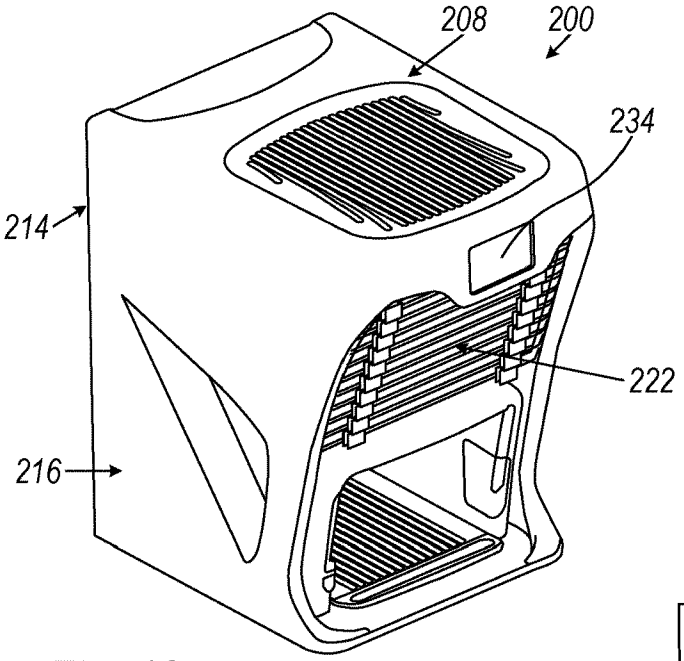
FIG. 10 is an isometric view of a folding machine.
Figure 14:
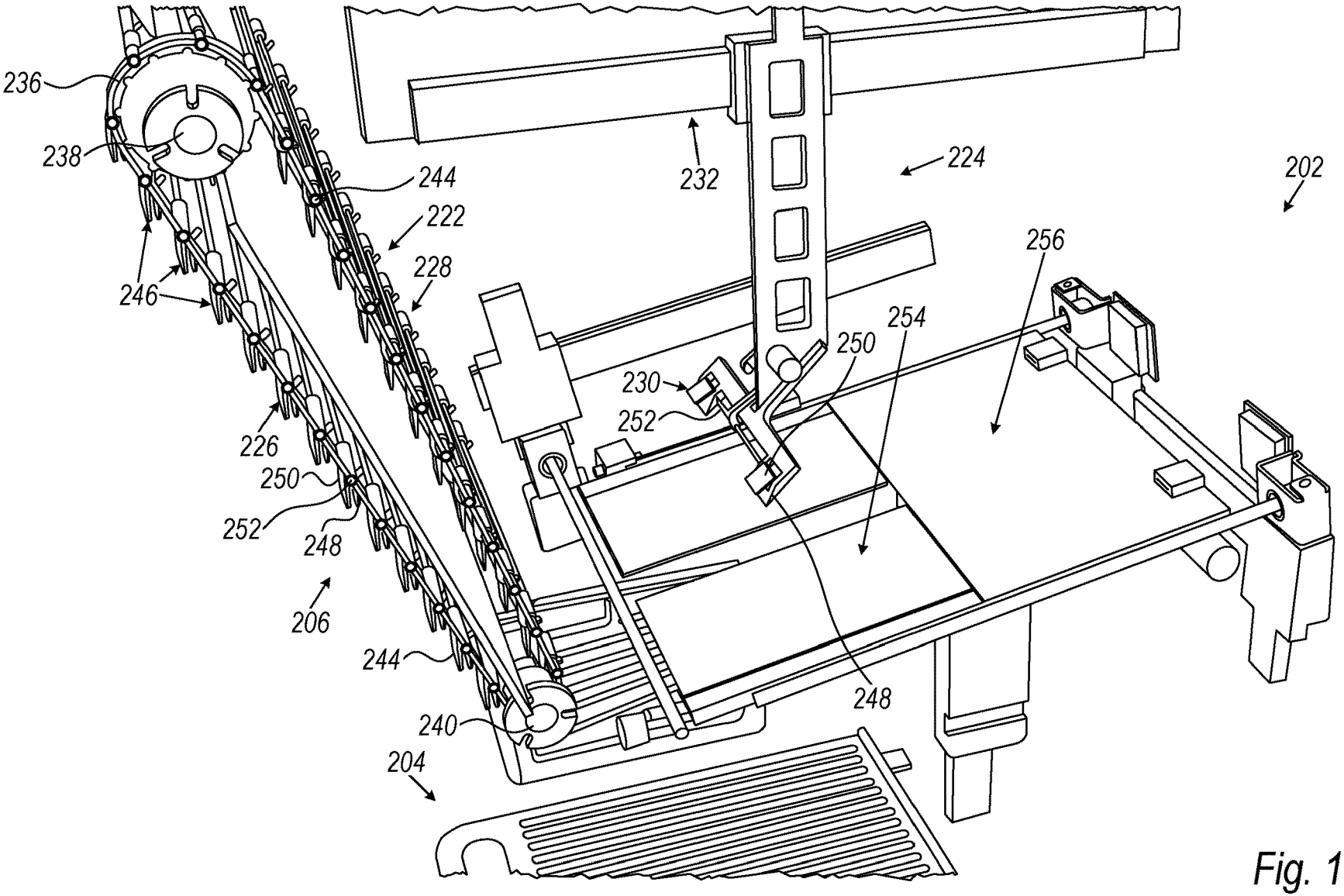
FIG. 14 is an isometric internal view of the folding machine of FIG. 1.

Attention is drawn to FIGS. 10 and 14. A folding machine 200 includes the abovementioned folding device 202, mechanisms and methods, and can include a stacking mechanism 204 for folded articles and/or a loading mechanism 206.

Attention is drawn to FIGS. 10-13. The folding machine 200 has machine top and bottom portions 208, 210 and machine front and rear portions 212, 214 which extend between the machine top and base portions 208, 210. The folding machine 200 has side portions 216 which extend between the top and base portions 208, 210. The folding machine 200 can have a trapezoidal shape in a plan view of the machine side portions 216. The folding machine 200 has virtual opposite machine top and bottom planes 218, 220 which are perpendicular to the machine side portions 216 and respectively pass through the front and rear portions 212, 214. The folding machine 200 can include, at the machine top, bottom, side, front or rear portions slanted surfaces which are configured to enable smooth movement of the articles inside the folding machine 200.

Attention is drawn to FIG. 14. According to some embodiments, the folding machine 200 includes a loading mechanism 206 which has a hanger rack 222 and a robot 224. The hanger rack 222 is located at the machine front portion 212 and the robot 224 is located inside the folding machine 200, behind the Hanger rack 222, and between the Hanger rack 222 and the machine rear portion. As will be further disclosed below, the Hanger rack 222 has hanger rack external and internal portions 226, 228. The Hanger rack 222 is configured to receive articles from the user at the hanger rack external portion 226, and move/transfer those inwards, inside the folding machine 200 to the internal portion 228.

The robot 224 is configured to pick up articles, or grab them from the hanger rack internal portion 228 and align and release them onto the folding device 202 for folding. The function of grabbing the article by the robot 224 from the Hanger rack 222 will be referred to herein as a 'handshake'. In some embodiments, the robot 224 is configured to move in a virtual midplane P which is perpendicular to the top and bottom planes and located midway between the machine side portions 216. The robot 224 includes a robot clamping mechanism which can include, e.g., two motorized clips 230. The motorized clips 230 can move independently along a robot rail 232 with respect to each other, at least for the purpose of enabling stretching or the articles.

The folding machine 200 can have a control console 234 (touch-screen, buttons, or other physical input means) located in the machine front portion 212. The control console 234 can be located at, or adjacent, a meeting between the machine front and top portion 212, 208. The control console 234 can be located midway between the machine side portions 216. The folding machine 200 can include wired/wireless communication modules, enabling remote operation.

Under normal use of the folding machine 200, the only physical contact between a user and the folding machine 200 is when the user places, or hands-over, the article to the hanger rack external portion 226, or when entering a command via the control console 234.

The Hanger rack 222 can have a carousel structure. According to some embodiments, the Hanger rack 222 has two opposite chains 236, each located at a meeting between a respective machine side portion 216 and the machine front portion 212. Each chain 236 is spread across/between, and revolves around, extremities of top and bottom bars 238, 240. The top and bottom bars 238, 240 are oriented perpendicularly to the machine side portions 216. The Hanger rack 222 has driving means—preferably an electric motor which can drive one or both the top and bottom bars 238, 240. The top bar 238 is located farther away from the machine rear portion 214 than the bottom bar 240. The top bar 238 is located adjacent the machine top portion 208 and the bottom bar 240 is located adjacent the machine bottom portion 210. In a side cross section of the folding machine 200, which is taken midway between the two machine side portions 216, an imaginary line which intersects the top and bottom bars 238, 240 can form an acute front portion inner angle α with the machine base plane 220. The front portion angle α can receive, e.g., a range of between 60 and 75 degrees, and is preferably 70 degrees.

The Hanger rack 222 has multiple hangers 242 which extend between, and are connected to, both chains 236 on each of the machine side portions 216. Each hanger 242 is preferably located further outwardly than the next hanger 242 under it. Each hanger 242 can have a smooth hanger rail 244 that can hold at least two clamping members 246, or hanger clips 246. Each hanger clip 246 is configured to releasably hold articles. In order to fit different article-sizes, and/or straightening the articles, the hanger clips 246 can be moved closer to or farther away from each other on each rail 244, in a lateral direction between the machine side portions 216. The hanger clips 246 can be configured to rotate about the hanger rail 244 simultaneously. In other words, each hanger clip 246 can have two degrees of freedom of movement with respect to the rail, but only one degree of movement with respect to each other.

According to other embodiments, the Hanger rack 222 includes two stationary, opposite, rigid and closed tracks. Multiple hangers circulate around the tracks, attached to inner chains. Each chain can bend in accordance with the shape of the track.

In order for the folding machine 200 to perform the handshake, each hanger clip 246 can be either passive, e.g., it can alternate between a clamping position and an open position, via an actuating spring, or, it can be active, e.g., actuated by an electric motor. Each hanger clip 246 is configured to receive and hold fabrics, and to release the fabric when, e.g., the article is removed from the hanger 242 by the user, or a handshake is occurring within the folding machine 200. For example, each hanger clip 246 can include a base jaw 248 and a clamping jaw 250 connected therewith via a pivot axle 252 (the pivot axle 252, can be, e.g., the hanger rail 252). The clamping jaw 250 can be connected to a spring and can move about the pivot axle 252. In the clamping position, i.e., closed and possibly holding fabric, the spring is tensed and a tip of the clamping jaw 250 is pressed onto the base jaw 248. In an open position, the clamping jaw 250 is spaced apart from the base jaw 248 and the spring can be tensed further relative to the tension in the clamping position.

The Hanger rack 222 and robot 224 can include an array of different types of sensors aimed to detect various scenarios such, e.g., when a fabric has been inserted into a hanger clip 246; when a hanger 242 has reached a predetermined handshake position; when a fabric has been clamped/moved from the Hanger rack 222 to the robot 224 etc.

Once the folding device 202 has completed folding the article, it can be moved to a stacking mechanism 204 preferably located beneath the folding device 202. Moving the articles to the stacking mechanism 204 can be done via a split trap door 254 which opens towards the machine bottom portion 210, or a similar mechanism, which simply drops the folded article to the stacking mechanism 204 thereunder. The stacking mechanism 204 can include a movable tray which can extend outwards to the machine front portion 212 to enable easy collecting of the articles.

The table 256, or article supporting surface, on which the robot 224 places the article is preferably tilted and forms an acute table angle β with the machine bottom plane 220. The table angle β can receive a range of between 15 and 50 degrees and is preferably 30 degrees. This is advantageous, since it contributes to minimizing the depth of the folding machine 200 in a front-to-rear direction.

The table 256 is therefore preferably unsmooth, i.e., it is configured to form friction with respect to the articles. This is advantageous to prevent the article from falling off, and also to assist the robot 224 with stretching the article, if necessary, in the front-to-rear direction. According to some embodiments, at least a portion of the table 256 can include a trap-door style opening 254, or doors, through which the articles can fall once the article has been folded.

According to some embodiments, the machine can offer customizable folding methods/styles.

Via the rotating rod, or folding member 44, the folding machine 200 can treat the fabric while folding it (Steam, Reduce wrinkles, Capsules, Perfume, softening, sanitization).

The folding machine 200, which includes a built-in loading and stacking mechanisms 204, 206 can be very compact, in terms of outer dimensions—for example, the folding machine 200 can be the size/volume of an average household dryer/washer machine, or even smaller than most. This is made possible due to the small volume which the holding member driving mechanism 258 takes up when the holding member 45 is contracted, while at the same time accomplishing a large holding member 45 length with an extended reach within the folding machine 200 when the holding member 45 is extracted.

A long felt need exists amongst households which relates to time and resources needed for folding laundry, at the expense of other family activities. Especially with large families, where a larger number of clothing articles are folded every day. Time is therefore an important factor when any domestic solution is considered. The folding machine is therefore only for domestic use, i.e., non-industrial. The current folding device 202 achieves the goal of saving time, space and with minimal relative monetary investment. Specifically, the driving mechanisms and methods disclosed herein minimize the total folding time to a minimum, never seen before in a compact, affordable folding machine 200. This technology enables total folding times of less than 10 minutes per article, and preferably less than 1 minute per article. In some embodiments of the machine, single article folding can take less than 10 seconds.

The holding member 45, can be made of metal, glass fibers, laminated metal, plastic etc. The holding member 45 has an elastic state, in which it is foldable/bendable in a longitudinal direction, and extends in more than a single direction. The holding member 45 has a rigid, or a relaxed state, in which it is considerably more rigid relative to the elastic state, and elongated in a single direction, in the longitudinal direction. In the relaxed state, the holding member 45 has a built-in, or preexisting, bend in a width direction, which gives it its rigidity in the longitudinal direction when extended—similarly to a measuring tape. In the rigid state, the holding member 45 can withstand relatively large bending moment without elastically changing direction/bending in the longitudinal direction, which allows the holding member 45 to force/press and hold articles in their place, or creating the folding line/crease.

In the longitudinal direction, the holding member 45 has a length axis X, located midway between elongated side edges (280) of the holding member 45.

In the width direction, perpendicular to the length axis X, the holding member 45 has a width axis Y.

The holding member 45 has a depth axis Z which extends perpendicularly to the length and width axes X, Y.

In the rigid state the holding member 45 can still slightly bend in the longitudinal direction, while the 'natural' bend in the width direction is maintained. This, only for very large (relative to its width) bend radiuses.

Figure 15:
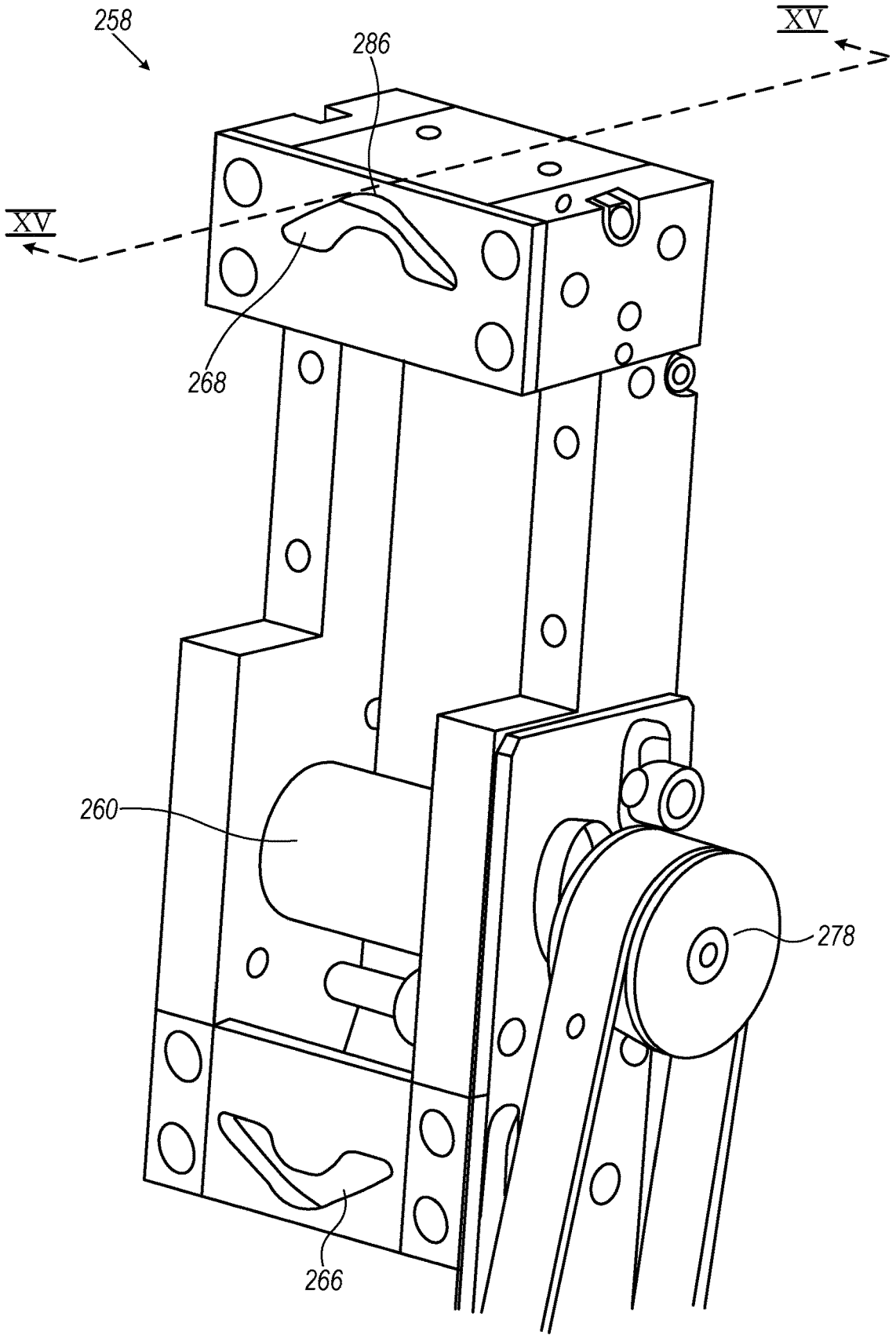
FIG. 15 is an isometric view of a holding member driving mechanism.

Attention is drawn to FIGS. 15-17. According to a first aspect, the driving mechanism 258 is made of two portions, or enclosures through which the holding member 45 passes. A driving portion 260 and, a separate, bending portion 262. The bending portion 262 can be connected to the driving portion 260 via a rail 264 (on which it can move) and according to the current aspect, the distance between the driving and bending portions 260, 262 can be actively altered.

The bending portion 262 has a bending portion body 264 and input and output openings 266, 268 located at two ends thereof. The holding member 45 enters the bending portion 262 via the input opening 266 (in a rigid state), and exits therefrom via the output opening 268 (also in a rigid state). The bending portion 262 is configured to bend the holding member 45 by forming an angle, or bend, in the longitudinal direction between a first holding member portion 270 (in a rigid state) which enters the bending portion 262 and a second holding member portion 272 (also in a rigid state) exiting the bending portion 262. At least a portion of the holding member 45 located between the first and second holding member portions 270, 272 is in a bent state. In the bent state, at a bend apex 284 in the longitudinal direction, the holding member 45 is substantially flattened, i.e., has a profile, cross-section (taken perpendicular to the length axis, or the longitudinal direction), which appears as a straight, or almost straight, line.

According to a second aspect (FIGS. 15-18), the holding member driving mechanism 258 has a unitary structure, i.e., includes a single structure, or enclosure (as depicted in the drawings) in which the holding member 45 is both driven, and bent in the desired direction. According to the second aspect, the input opening 266 is located at a fixed distance from the output opening 268. In an assembled position, the article is always located between the input and output openings 266, 268 in a longitudinal direction of the driving mechanism 258. The driving mechanism 258 and the table 256 on which the article is located, are configured to move with respect to one another (in all desired directions), within said distance between the input and output openings 266, 268 (to release or hold the article).

In both abovementioned aspects, the driving mechanism 258 has a driving motor. In some aspects, the driving motor is located within the driving portion 260, and in others, externally to the unitary driving mechanism 258.

In both abovementioned aspects, the bending and/or driving portions 260, 262 are movable in any desired direction relative to the folding table 256. In other words, the driving mechanism 258 and folding table 256 can move in any direction or angle with respect to one another.

The driving mechanism 258 can advantageously mechanically manipulate the holding member 45 in order to achieve more rigidity when it is exerted outwardly and applies forces on the article. There are several constructional aspects which can improve said rigidity, while at the same time, retaining the required flexibility to bend the holding member 45 in order to change its direction, or fold it to save space in the folding machine 200.

The shape of the input and output openings 266, 268 is not a parallelogram. Specifically, the shape can have a shape with a bend in its middle. The shape can correspond to a cross section of the holding member 45, i.e., it can have a first portion with concave profile and an opposite second portion with a convex profile.

Aspects of improvements, which are combinable with each other, and with any of the aspects mentioned above:

1. Support members 276, and driving members 278, preferably contacting the holding member 45 at its middle. Specifically, along a line, or a strip-portion 282, passing midway between the two, substantially parallel side edges (280) of the holding member 45. In other words, the driving and support members 278, 276 contact the holding member 45 at a middle of a natural, built-in bend of the holding member 45 in a relaxed position, when no other external force is applied.
2. Any contact with the holding member 45 (driving, locating, leading, winding or folding) is preferable only before or after a bend in the direction of the length axis X, or the longitudinal direction. For example, the holding member 45 can be driven before the holding member 45 enters the bending portion 262, and/or after the holding member 45 exits therefrom.
3. In order to drive the holding member 45, to locate it, to support it, or to carry it, it is preferable that it is done at a portion of the tape which is in the relaxed position (not bent in the direction of the length axis X).
4. The upper portion of the output opening 268 is not straight, since it would serve as a counter force and bend the holding member 45 at the natural bend in the direction of the width axis Y. As known in the field of measuring tapes, straightening the natural bend between the side edges (280) will most likely cause a bend in the longitudinal direction in the length axis X (with the apex 284).
5. The upper portion of the output opening 268 can include a relief concave portion 286, which forces the holding member 45 into the concave portion to further increase the built in bend in the width axis Y direction.
6. The output opening 268 can be aligned (located opposite of, at the same horizontal and lateral location) with an optional holding member anchor 290 (FIG. 14), which includes a recess with a matching shape which corresponds to the shape of the holding member 45. The holding member anchor 290 is configured to catch, or support the holding member 45 when it is at its maximum extension, and improve rigidity of the holding member 45, thus improving the clamping forces the holding member 45 applies on the article.

These abovementioned characteristics enable the driving mechanism 258 to extract and retract the holding member 45, very quickly, in matter of few seconds, and in some cases less than a second. This is crucial for ultimately achieving article folding, where a quick, smooth, and non-intrusive force-applying mechanism is required

The invention claimed is:

1. A compact domestic article folding machine (200) configured for autonomous article folding and having machine top and bottom portions (208, 210) and a uniform body extending therebetween and comprising machine front, rear and side portions (212, 214, 216), the folding machine (200) comprising:

a hanger rack (222) located at the front portion (212) and configured for receiving articles from a user at a rack external portion (226) and moving them inside the folding machine (200);

a folding device (202) located between the front and rear portions (212, 214); and a robot (224) configured for moving each article from a rack internal portion (228) to the folding device (202) to be folded.

2. The folding machine (200) according to claim 1, wherein the hanger rack (222) comprises top and bottom bars (238, 240) connected by two chains (236) onto which multiple hangers (242) are clamped, and wherein the top bar (238) is located farther away from the machine rear portion (214) than the bottom bar (240).

3. The folding machine (200) according to claim 1, wherein the folding device (202) is configured for creating a fold in a fabric article and comprises:

a table (256) for supporting the fabric article;

a holding member (45) which has an elongated holding axis and adjustable between a retracted position and an extended position;

a folding member (44) which has an elongated folding axis and movable in a direction perpendicular to the holding axis, the folding member (44) is configured to create a fold in the fabric article along the holding member (45) by carrying at least a portion of the fabric article over the holding member (45);

a motor operatively connected to at least one of the holding member (45) and the folding member (44); and a movement means configured to adjust a distance between the holding member (45) and the fabric article;

characterized in that the holding member (45) is configured to retract and leave the fold.

4. The folding machine (200) according to claim 3, wherein the folding member (44) includes fluid or gas conveying channels, and is configured for fabric treatment via said channels.

5. The folding machine (200) according to claim 3, wherein the holding member (45) is a concave-convex tape.

6. The folding machine (200) according to claim 3, wherein the folding member (44) is a cylindrical rod configured to rotate about the folding axis.

7. The folding machine (200) according to claim 3, wherein the folding member (44) is configured to vibrate to overcome entanglement or snags in the fabric.

8. The folding machine (200) according to claim 3, wherein the folding member (44) is not retractable.

9. The folding machine (200) according to claim 3, wherein the folding device (202) comprises:

first and second holding members (45) and first and second folding members (44) arranged in pairs, each pair comprises one holding member (45) and one folding member (44), wherein the first pair is oriented perpendicular to the second pair.

10. The folding machine (200) according to claim 1, wherein the total folding time is less than 1 minute per article being folded.

* * * * *